US011000080B1

(12) United States Patent
Hall

(10) Patent No.: US 11,000,080 B1
(45) Date of Patent: May 11, 2021

(54) FITTABLE FACEMASKS AND RELATED METHODS OF MANUFACTURE AND CUSTOMIZATION

(71) Applicant: ActivArmor LLC, Pueblo, CO (US)

(72) Inventor: Diana Hall, Pueblo, CO (US)

(73) Assignee: ActivArmor LLC, Pueblo, CO (US)

( * ) Notice: Subject to any disclaimer, the term of this patent is extended or adjusted under 35 U.S.C. 154(b) by 0 days.

(21) Appl. No.: 17/011,842

(22) Filed: Sep. 3, 2020

Related U.S. Application Data

(60) Provisional application No. 63/029,169, filed on May 22, 2020, provisional application No. 62/994,287, filed on Mar. 25, 2020.

(51) Int. Cl.
*A41D 13/11* (2006.01)
*A62B 18/02* (2006.01)
*A62B 23/02* (2006.01)

(52) U.S. Cl.
CPC ..... *A41D 13/1107* (2013.01); *A41D 13/1161* (2013.01); *A62B 18/025* (2013.01); *A62B 23/02* (2013.01)

(58) Field of Classification Search
CPC ..... A41D 13/1107; A41D 13/1161; A41D 13/11; A41D 13/1146; A62B 18/025; A62B 18/02; A62B 23/02; A62B 7/10; A61M 16/06; A61M 2016/0661; B29L 2031/4835; A61K 8/0212
See application file for complete search history.

(56) References Cited

U.S. PATENT DOCUMENTS 6,196,223 B1 * 3/2001 Belfer ..... A41D 13/1176 128/205.25
2006/0254592 A1 * 11/2006 Anders ..... A62B 23/02 128/206.21
2012/0103339 A1 * 5/2012 Koehler ..... A62B 18/02 128/206.14
2016/0250434 A1 * 9/2016 Asvadi ..... A61M 16/0622 128/205.25

* cited by examiner

*Primary Examiner* — Margaret M Luarca
(74) *Attorney, Agent, or Firm* — Plumsea Law Group, LLC

(57) ABSTRACT

A facemask is provided that is made from a clear thermoplastic polymer with a sufficiently low glass transition temperature that a customer may engage in post-sale customization of the facemask. The facemask is configured to be heated and then reshaped by the customer, so as to better fit the customer's face. The facemask may include filter cavities or filter adaptors that conveniently hold removable filters. Methods of manufacturing a set of a plurality of facemasks, matching a customer to an appropriately sized facemask, and then enabling the customer to engage in post-sale customization are also provided.

11 Claims, 31 Drawing Sheets

FITTABLE FACEMASKS AND RELATED METHODS OF MANUFACTURE AND CUSTOMIZATION

CROSS-REFERENCE TO RELATED APPLICATIONS

This application claims the benefit of Provisional Patent Application No. 62/994,287 filed Mar. 25, 2020, and titled "Custom-fit and/or Designed, Thermoformed N95 Respirators," which is incorporated by reference herein in its entirety.

This application also claims the benefit of Provisional Patent Application No. 63/029,169 filed May 22, 2020, and titled "Fittable Facemasks and Related Methods of Manufacture and Customization", which is incorporated by reference herein in its entirety.

BACKGROUND

The present disclosure relates to the field of protective facemasks. In particular, this disclosure relates to custom fitted reusable facemasks that are transparent, lightweight, and have removable filters.

Existing facemasks are used in a variety of medical, industrial, and personal settings. Many such facemasks rely on pressure to deform the facemask into fitting a user's face. For example, one or more straps may be tightened to force a facemask onto a user's face so as to create an air seal. This may be uncomfortable to the user over long periods of time, or may create additional complications for users with e.g. skin conditions that cause sensitivity to pressure on the face. Other facemasks may not include an air seal at all, allowing particulate matter to circumvent the filtration system.

Existing facemasks may also suffer from other deficiencies. For example, known facemasks generally obscure the user's mouth in such a way that makes understanding the user's speech to be difficult. Additional, many existing facemasks are disposable "one time use" facemasks—or use disposable filters. This may result in high turnover in the usage of the facemasks, potentially resulting in higher cost of use as well as shortages.

Accordingly, there is a need in the art for improved facemasks that address these and other shortcomings in the art.

SUMMARY

In one aspect, this disclosure provides a facemask, comprising: a facemask unibody comprising a clear thermoplastic polymer; an airflow hole in the facemask unibody, configured to allow airflow from an outer side the facemask into an inner side of the facemask; a removable filter covering the airflow hole; the airflow hole and the removable filter being located on the facemask in a location that is adjacent to a user's mouth when worn; and a strap; wherein the facemask unibody is a single continuous piece of polymer having a shape such that the facemask covers the user's mouth and nose when worn; wherein the facemask unibody has a shape such that the facemask conforms to the user's nose bridge, upper cheeks, lower cheeks, and chin thereby creating a seal between the facemask and the user's skin when worn; and wherein the thermoplastic polymer has a glass transition temperature of less than about 100 degrees Celsius, such that the facemask is configured to be heated by a user in order to adjust the facemask from a first shape to a second shape in order to better fit the user's face.

In another aspect, this disclosure provides a facemask, comprising: a facemask unibody comprising a clear thermoplastic polymer; a first filter cavity in the facemask unibody, the first filter cavity including a first airflow hole configured to allow airflow from an outer side the facemask into an inner side of the facemask, and a first removable filter covering the first airflow hole on the inner side of the facemask; a second filter cavity in the facemask unibody, the second filter cavity including a second airflow hole configured to allow airflow from an outer side the facemask into an inner side of the facemask, and a second removable filter covering the second airflow hole on the inner side of the facemask, the first removable filter and the second removable filter being located on the facemask in a location that is laterally adjacent to a user's mouth when worn; and a strap; wherein the facemask unibody has a semi-ridged shape such that the facemask covers the user's mouth and nose when worn; wherein the facemask unibody has a semi-ridged shape such that the facemask conforms to the user's nose bridge, upper cheeks, lower cheeks, and chin thereby creating a seal between the facemask and the user's skin when worn; and wherein the first filter cavity includes a first filter snap-in ridge configured to hold in place a first filter frame associated with the first removable filter, and the second filter cavity includes a second filter snap-in ridge configured to hold in place a second filter frame associated with the second removable filter.

In another aspect, this disclosure provides a facemask, comprising: a facemask unibody consisting essentially of a clear thermoplastic polymer; an airflow hole in the facemask unibody, configured to allow airflow from an outer side the facemask into an inner side of the facemask; an inner filter adaptor including an inner rim disposed adjacent to, and extending parallel with, an inner surface of the facemask unibody, the inner filter adaptor further including an sidewall extending outward through the airflow hole; an outer filter adaptor configured to house a removable filter between the outer filter adaptor and the inner filter adaptor, such that the removable filter covers the airflow hole in the facemask unibody as held in place by the inner and outer filter adaptors; the airflow hole and the removable filter being located on the facemask in a location that is adjacent to a user's mouth when worn; and a strap; wherein the facemask unibody has a semi-ridged shape such that the facemask covers the user's mouth and nose when worn; wherein the facemask unibody has a semi-ridged shape such that the facemask conforms to the user's nose bridge, upper cheeks, lower cheeks, and chin thereby creating a seal between the facemask and the user's skin when worn; and wherein the thermoplastic polymer has a glass transition temperature of less than about 100 degrees Celsius, such that the facemask is configured to be heated by a user in order to adjust the facemask from a first shape to a second shape in order to better fit the user's face.

In still another aspect, this disclosure provides a method of manufacturing a set of facemasks comprising: generating a set of a plurality of facemask molds, each facemask mold differing from each other facemask mold with respect to at least one of height and width; thermoforming a clear thermoplastic polymer onto each of the plurality of facemask molds to form each respective facemask unibody, wherein the clear thermoplastic polymer has a glass transition temperature of less than about 100 degrees Celsius; assembling a removable re-usable filter; inserting the removable re-usable filter into the facemask unibody; and attaching a strap to the facemask unibody; wherein the step of assembling a removable re-usable filter includes: producing an inner filter frame and an outer filter frame; placing the inner filter frame onto a filter form, the filter form including a raised portion with a shape substantially the same as an inner shape of the inner filter frame; placing a filter fabric over the raised portion of the filter form, folding the filter fabric down so as to be adjacent to the inner filter frame, and attaching the filter fabric to the inner filter frame; placing the outer filter frame around the inner filter frame on top of the filter fabric, and attaching the outer filter frame to the filter fabric; and wherein the raised portion has a predetermined height such that a total area of filter fabric included in the filter is at least 10.5 square inches.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Customizable facemasks and related methods of manufacture and customization are described herein. Generally, facemasks in accordance with this disclosure may be manufactured from a clear thermoplastic polymer that can be heated by an end user to change the shape of the facemask to better fit the user's face. As a result, the user may experience a better fit to their face with less pressure applied by the strap than conventional known facemasks. The facemasks may also enable improved communication by showing the user's mouth and lips through the clear plastic unibody. The facemasks may also include removable filters, which may also be re-useable—thus reducing waste and environmental impact as compared to disposable masks.

Generally, a facemask as that term is used herein may refer to any article that is designed to cover a portion of a human user's face. Typical facemasks may cover a user's mouth and nose, and serve to reduce the inhalation and exhalation of particulates or droplets. Facemasks may broadly include articles that form an airtight seal between the facemask and the user's face, as well as articles that form a partial seal, as well as articles that merely provide a physical barrier to the travel of particulates or droplets in only certain paths to a wear's mouth or nose.

Figure 1A:
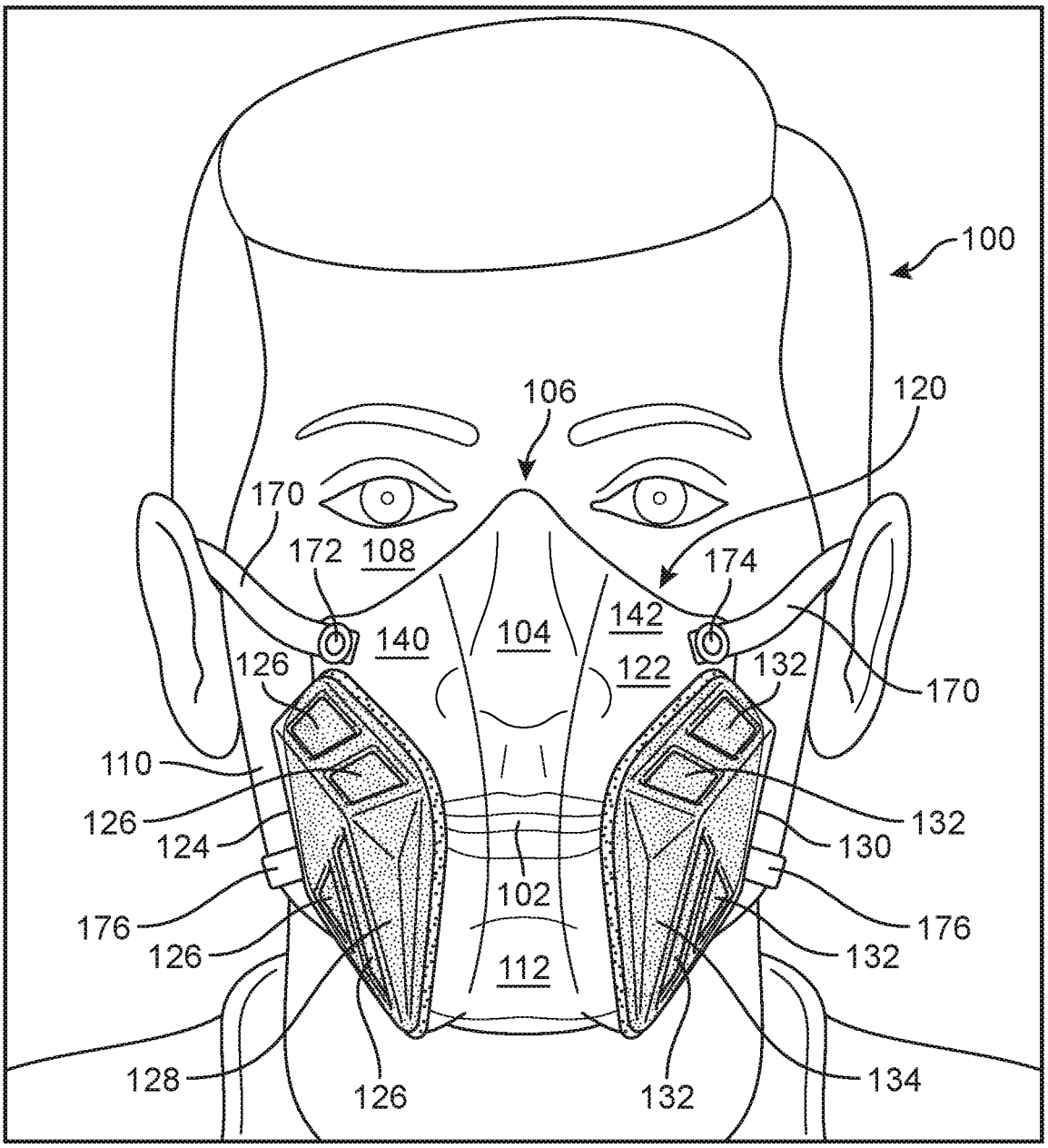
FIG. 1A is a front-facing view of a user wearing a first embodiment of a facemask in accordance with this disclosure.

A 120 facemask according to the present disclosure is shown in FIG. 1A. This facemask is made from a clear thermoplastic polymer, so that the body 122 of the facemask 120 may be transparent. Wearer 100 dons the facemask 120 to cover the wear's mouth 102 and nose 104 when worn, and the facemask body 122 is configured to have a shape so as to cover a user's mouth and nose when worn. In particular, facemask body 122 may be configured to have a shape such that the facemask 120 conforms to the wearer's nose bridge 106, the wearer's upper cheeks 108, the wearer's lower cheeks 110, and the wearer's chin 112. By having this shape, the facemask body 122 may cause the facemask 120 to create an airtight seal between the facemask 120 and the user 100's skin. This may ensure that all airflow passes through the filters (128, 134) so that facemask 120 may protect user 100 from particulate matter in the air.

Facemask 120 may therefore include first filter 128 in a first filter cavity 124. First filter cavity 124 may be a formed portion of facemask body 122 that is shaped so as to contain first filter 128 therein. In the embodiment of facemask 120, first filter 128 is contained on an inner side of the facemask—adjacent to the user's 100 face. First filter cavity 124 may also include a plurality of airflow holes 126. Airflow holes 126 may be holes through the facemask body 122 that allow air to travel from an outer side of the facemask 120 to an inner side, and vice versa. As a result of the seal formed between facemask 120 and user 100's skin across the user's face (106, 108, 110, 112), the only air that may pass from an outer side of facemask 120 to an inner side of facemask 120 must pass through the filters (128, 134).

First filter cavity 124 and first filter 128 contained therein may be located so as to cover a wearer's 100 cheek 110 when worn. In this way, this shape of the facemask body 122 and facemask 120 may leave the user's mouth 102 substantially unobstructed by the filter 128. Namely, first filter cavity 124 and first filter 128 therein may be located on a first lateral side 140 of the facemask 120 adjacent to a wearer's 100 mouth 102.

Similarly, facemask 120 may include a second filter cavity 130 containing a second filter 134 therein. Second filter cavity 130 may be substantially similar in shape and configuration to first filter cavity 124, except located on second lateral side 142 adjacent to the other side of the wearer's 100 mouth 102. Namely, second filter cavity 130 may also include a plurality of airflow holes 132 in the facemask body 122 that allow air to pass from one side of the facemask 120 to the other side, and back again as the wearer breathes in and out. Thus, the location of second filter cavity 130 on facemask body 122 may leave the user's mouth 102 substantially or totally unobstructed by second filter 134.

Facemask 120 may fully cover the wearer's mouth 102 and nose 104, precluding any airflow except through the filters. However, because body 122 of the facemask 120 is transparent—and also due to the location of the filter cavities and associated filters—the wear's mouth may nonetheless still be visible to observers through the facemask 120. This configuration that allows the user's mouth 102 to be visible through facemask 120 may be advantageous in aiding communication in variety of situations, as compared to a traditional facemask that obscures the user's mouth and lips. For example, the ability to see a wearer's facial expressions as expressed through movements of the mouth 102 and lips can be a key part of understanding the full intent and context of an otherwise verbal interpersonal communication. This may be acutely useful in, for example, the medical field—such as surgeons communicating with other members of the surgical suite, or mental health works seeking to establish emotional trust with a patient. This may also be advantageous for, for example, persons of impaired hearing who communicate by reading lips. More broadly, the ability to see a substantial portion of the wearer's 100 face through the facemask 120—and in particular the key features of the shape and appearance of the mouth 102 and nose 104—may allow the user to be identified by their facial features. This may aid in visual identification by other people, or by facial recognition technology.

Facemask 120 may also include means for restraining the facemask 120 on user's 100 face. Namely, facemask 120 may include upper strap 170 and lower strap 176. Upper strap 170 may attach to facemask body 122 by attachment means 172 and 174, which may be grommets. Lower strap 176 may similarly attach to facemask body 122.

Figure 1B:
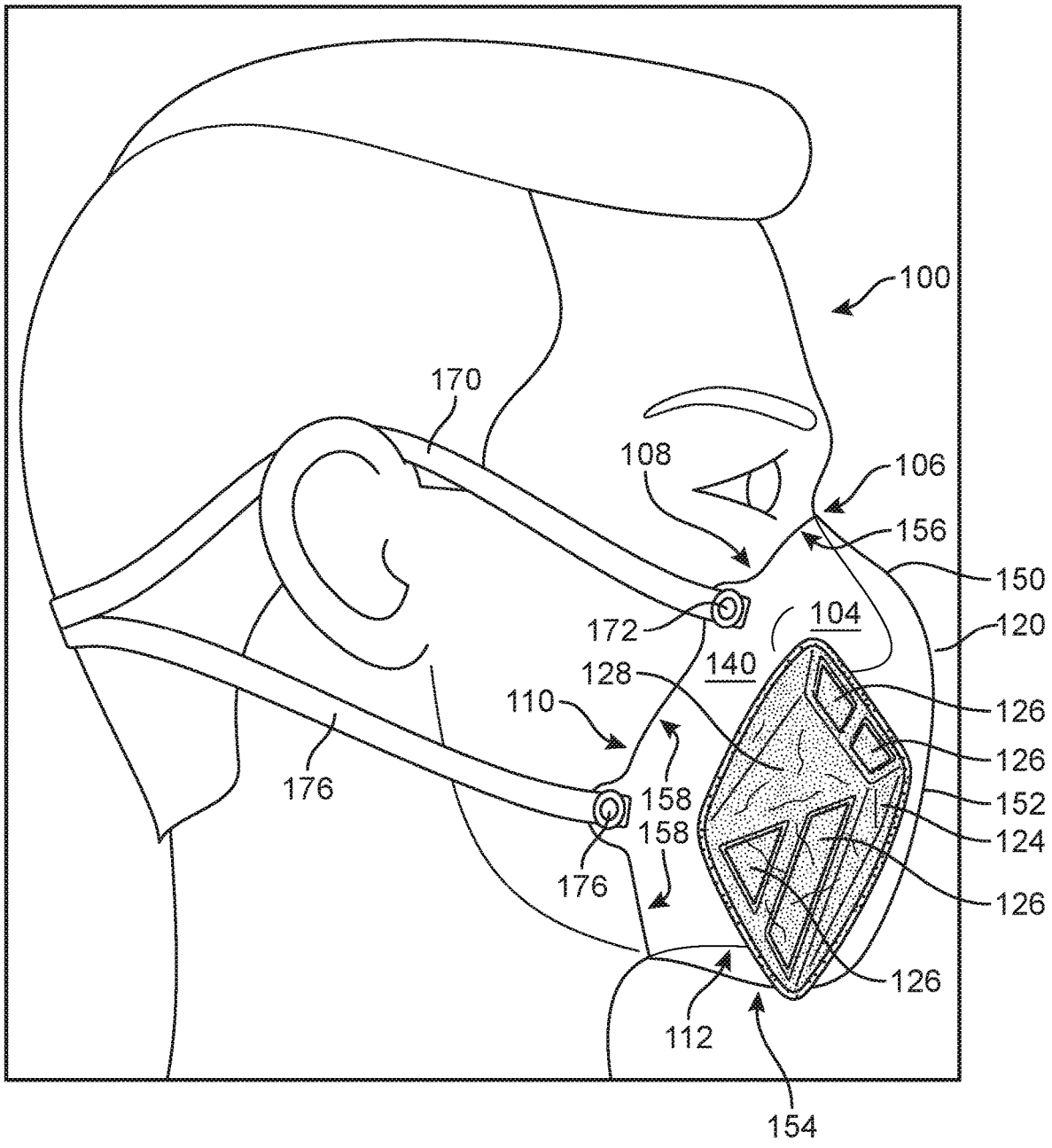
FIG. 1B is a side-facing view of a user wearing the first facemask.

FIG. 1B shows many of the features of FIG. 1A in further detail. Namely, FIG. 1B shows how facemask 120 may cover the wearer's nose bridge 106, upper cheeks 108, lower cheeks 110, and chin 112. Namely, edge 156 of facemask body 122 may engage with wearer's nose bridge 106 and upper cheeks 108. Edge 158 of facemask body 122 may similarly engage with wearer's lower cheeks 110 and chin 112. In this way, each edge of the facemask body 122 may form an airtight seal with the user's 100 face.

The side view shown in FIG. 1B also illustrates how the facemask body 122 may generally be considered to include three regions. Top portion 150 may generally cover the user's nose 104. Middle portion 152 may generally cover the user's mouth 102 (not visible in this figure). Bottom portion 154 may generally cover the user's chin 112. In some embodiments, facemask 120 may be considered to be low profile—because middle portion 152 does not extend far beyond the depth of the user's nose 106 and chin 122 by a large margin. Namely, a low profile facemask 120 may be one in which middle portion 152 extends beyond the tip of the user's nose 106 and chin 112 by a depth that does not exceed the larger of the depth of the user's nose 106 or the depth of the user's chin 112, relative to the rest of the user's 100 face. In this way, a low profile facemask 120 may aid in the user's 100 face and neck movement. A low profile mask may also have a reduced weight as compared to other masks, thereby reducing strain on the user's neck.

Figure 2A:
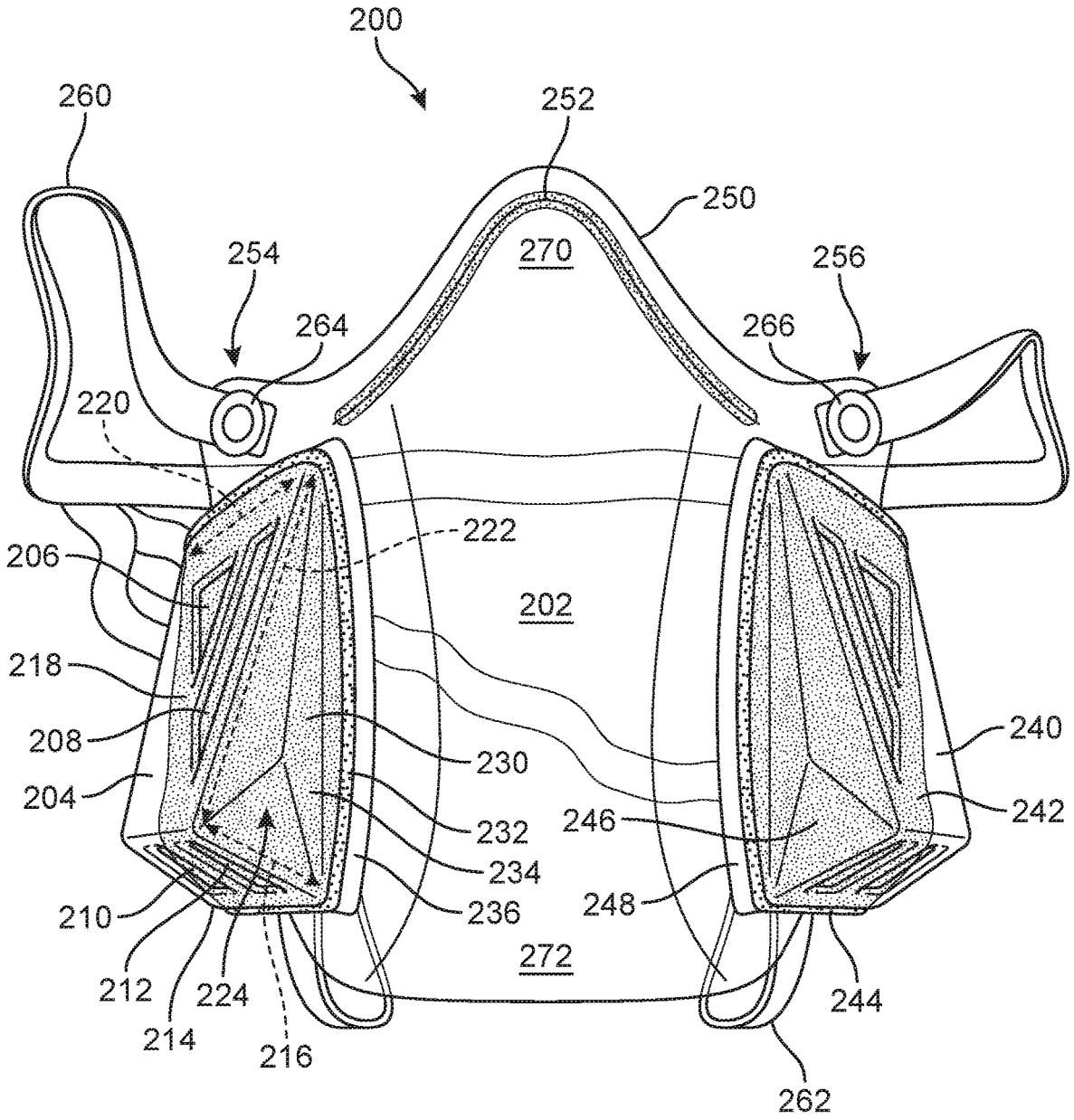
FIG. 2A is a front view of a second embodiment of a facemask in accordance with this disclosure.

FIG. 2A shows a second embodiment of a facemask 200 in accordance with this disclosure. Facemask 200 may include facemask body 202 that includes a first filter cavity 204 and a second filter cavity 240 formed therein. Aside from facemask body 202, facemask 200 may also include upper strap 260 (and associated attachment means 264/266), lower strap 262 (and associated attachment means), first filter 230, second filter 242, and reinforcement strip 252.

First, in this embodiment shown in FIG. 2A, facemask body 202 may include an outer rim tab 250. Outer rim tab 250 may extend around a perimeter of facemask 200, and may be configured at a substantially right angle relative to the rest of facemask body 202. Outer rim tab 250 may therefore aid in forming an airtight seal between facemask 200 and a wearer's face. A reinforcement strip 252 may be disposed where outer rim tab 250 meets the remainder of facemask body 202. Reinforcement strip 252 may be a bead of silicone, such as commercially available GE all-purpose silicone. Reinforcement strip 252 may aid in ensuring that outer rim tab 250 does not crack after repeated usage of facemask 200.

Next, in this embodiment shown in FIG. 2A, facemask body 202 may include first attachment tab 254 and second attachment tab 256. First attachment tab 254 may be where first attachment means 264 connects facemask body 202 to upper strap 260. Second attachment tab 256 may be where second attachment means 266 connects facemask body 202 to upper strap 260. The attachment tab 254/256 may extend outward from the main portion of facemask body 202, in order to allow the attachment tabs 254/256 to connect to the straps without otherwise interfering with the seal formed between the facemask body 202 and the user's face. Attachment tabs such as 254 and 256 that are integrated into facemask body 202 may advantageously allow for easy and secure attachment of one or more straps without adding undue additional weight or complexity to facemask 200.

FIG. 2A also shows the filter cavities in greater detail. Namely, first filter cavity 204 and second filter cavity 240 are each continuous portions of the facemask body 202 that are shaped to hold the respective filters. First filter cavity 204 may therefore include first airflow hole 206 and second airflow hole 208 on top surface 218 of the cavity 204. First filter cavity 204 may then also include third airflow hole 210 and fourth airflow hole 212 on bottom surface 214. First filter cavity 204 may then also include side surface 224.

First filter cavity 204 may have dimensions of depth 216, width 220, and length 222. First filter cavity depth 216 may extend laterally outward from a surrounding area of the facemask body 202 as shown. Depth 216 may be sufficiently deep as to allow filter material 234 to expand therein. That is, depth 216 of filter cavity 204 may allow space for airflow to pass over and through filter material 234 in order to enter (or exit) the facemask. By including this depth 216, this configuration may advantageously allow the same airflow through the filter 230 while also allowing the filter 230 to take up a smaller "footprint" area on the facemask 200. That is, filter 230 may have a smaller perimeter than would otherwise be necessary for the same amount of airflow because depth 216 allows the filter material 234 to expand laterally outward into depth 216. This may allow facemask 200 to make a wearer's face more visible, because less of the wearer's face may be obscured by the (not transparent) filter 230 than would otherwise be the case for a filter having the same total amount of filter material 234 on e.g. a flat plane. In this way, the configuration of the filter cavities shown in FIG. 2A advantageously may allow facemask 200 to better allow visibility of the wearer's mouth, lips, and facial expressions.

FIG. 2A also shows how first filter 230 may include filter material 234 and also filter frame 232. Filter frame 232 may be a plastic piece that holds filter material 234 and allows filter 230 to be removable from facemask 200. Namely, filter frame 232 may surround a perimeter of filter material 234 and contain it, as described below with respect to FIG. 9A-9E. Filter frame 232 may reversibly engage with snap-in ridge 236 in filter cavity 204 in order to keep filter 230 in place inside filter cavity 204. Namely, snap-in ridge 236 may be a portion of facemask body 202 that is slightly narrower than, but otherwise substantially similar in shape to, filter frame 234. Filter frame 234 may therefore slightly deform to fit past snap-in ridge 236, and then snap-in ridge 236 may hold filter frame 234 in place inside filter cavity 204. This configuration of integrated snap-in ridge 236 may advantageously allow filter 230 to be securely retained within filter cavity 204 without the use of other reversible attachment means that would otherwise add weight and complexity to facemask 200.

Facemask 200 may also include second filter cavity 240, that includes second filter 242. Second filter cavity 240 may be substantially similar to first filter cavity 204, except located on an opposite side of facemask 200. Namely, first filter cavity 204 and second filter cavity 240 may be laterally symmetric. That is, the left side and the right side of facemask 200 may be substantially the same. In both cases, each filter 230/242 may be located in the respective filter cavity 204/240 so as to be covering each of the plurality of airflow holes (206, 208, 210, 212 etc.) on an inner side of facemask 200. In this way, the only air that may move from outside the facemask 200 to inside must go through airflow holes (206 etc.) and then pass through filters 204/240 so that filters 204/240 may prevent inhalation of any particular mater that may be present in the air.

Figure 2B:
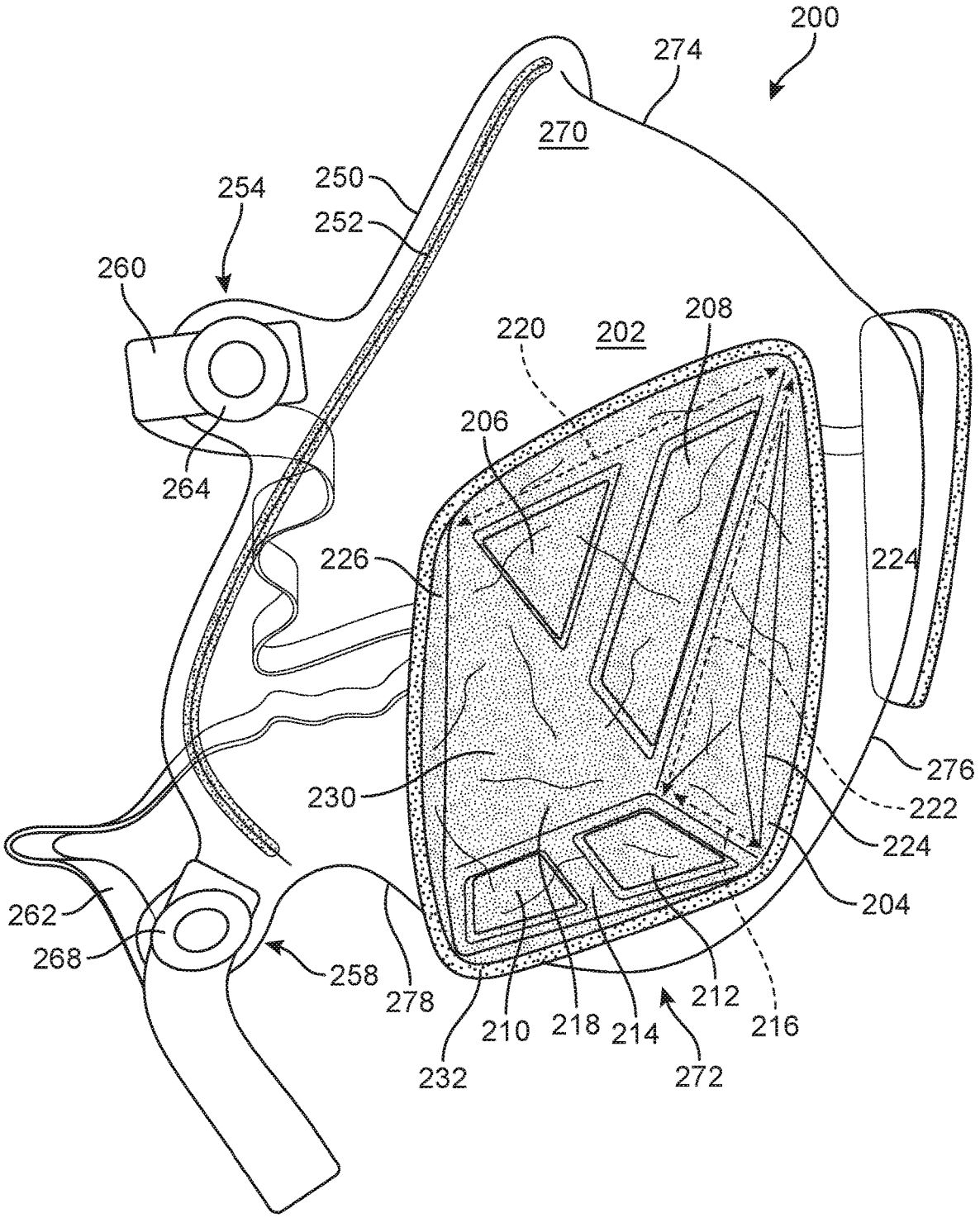
FIG. 2B is a side view of the second facemask.

FIG. 2B shows a side view of facemask 200. In this view, reinforcement strip 252 is shown in additional detail. Namely, reinforcement strip 252 extends along outer rim tab 250 along substantially the entire circumference of facemask body 202. In this way, the entire rim of facemask 200 may be structurally reinforced to prevent any potential cracking or tearing of facemask body 202.

First filter cavity 204 is also shown in greater detail in FIG. 2B. Namely, first filter cavity 204 may have depth 216 at area adjacent to bottom side 214. A depth of filter cavity 204 may taper to a substantially minimal depth along a length 220 that extends from bottom side 214 upward. In this way, airflow that passes through bottom airflow holes 210 and 212 may be directed across and through filter 230 inside of filter cavity 204. This configuration may also enable a higher total surface area of a filter 230 to be contained within the filter cavity 204 than would otherwise be possible with a filter and filter cavity that were substantially flat.

Facemask 200 as shown in FIG. 2B may include nose region 270 and mouth region 272. Nose region 270 may include top surface 274, while mouth region 272 may include front surface 276 and bottom surface 278.

Figure 2C:
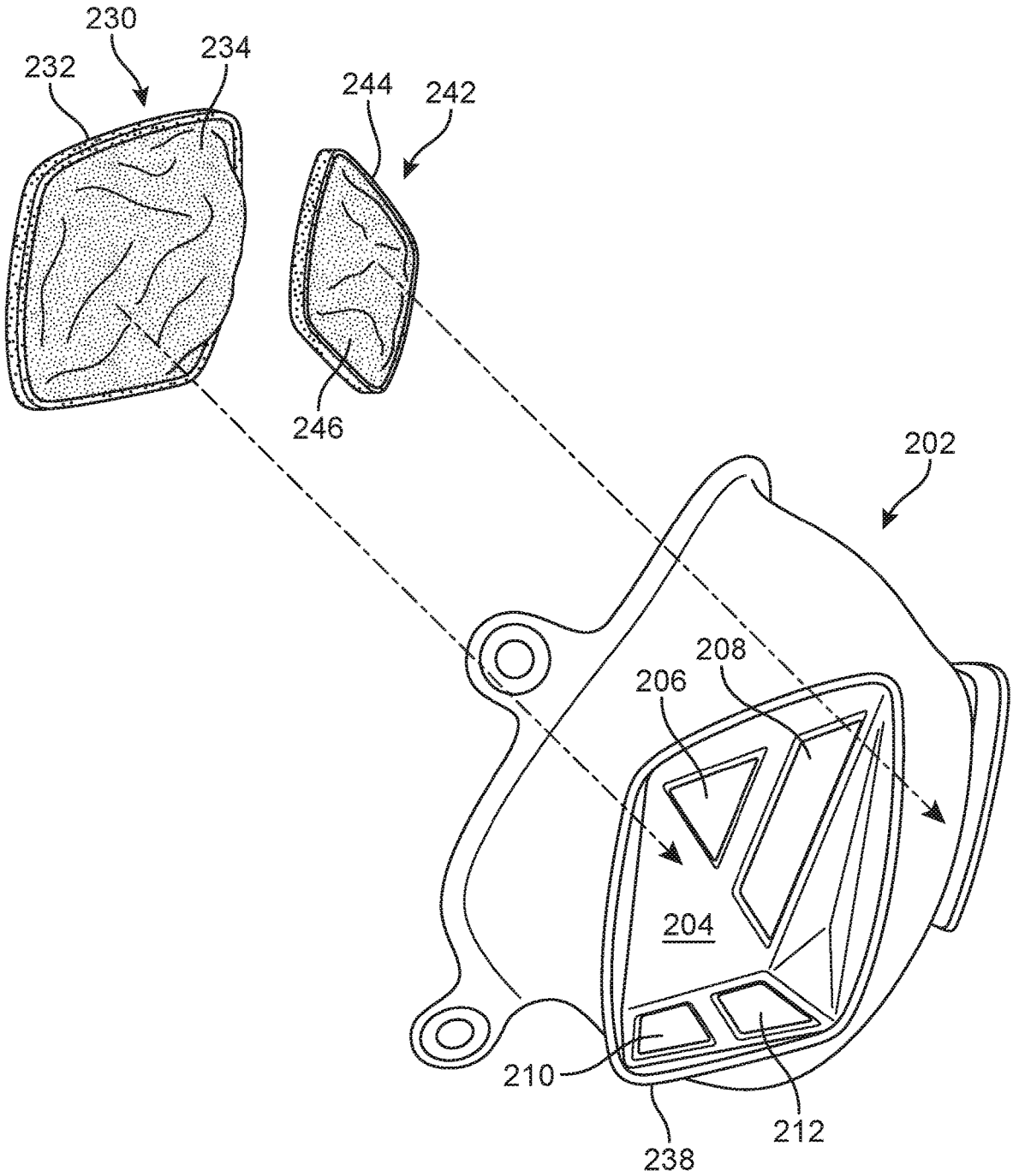
FIG. 2C is an exploded view of two filters as separated from the facemask unibody that make up the second facemask.

FIG. 2C shows facemask body 202 with filters 230/242 separated. In some embodiments, facemask body 202 may be a single, unitary piece of polymer that is formed into the shape as variously shown and discussed herein. Namely, facemask body 202 may be referred to as facemask unibody 202 because it may be a single continuous piece of polymer that is formed of a transparent thermoplastic polymer. A polymer may be considered transparent when it appears clear, such that visible light passes through the polymer and objects on one side of the facemask unibody 202 are visible through the facemask unibody 202 when viewed on the other side.

A thermoplastic polymer, as is generally known in the art, is a polymer material which becomes pliable or moldable at a certain elevated temperature—and solidifies upon cooling. A thermoplastic polymer can generally be heated and re-shaped, and will hold the re-shaped form after cooling. The elevated temperature at which the thermoplastic polymer becomes moldable is generally referred to as the glass transition temperature.

Generally, a clear thermoplastic polymer used to form the facemask unibody 202 may have a glass transition temperature of less than about 100 degrees Celsius. With a glass transition temperature of less than 100 degrees Celsius, the facemask unibody 202 may be heated by readily available means such as boiling water. Advantageously, this may allow the user to reshape facemask unibody 202 at home without specialized equipment. This may be used in a process for customizing the shape of the facemask 200, as discussed variously below.

One clear thermoplastic polymer having a glass transition temperature of less than about 100 degrees Celsius that may be used to form the facemask unibody may be PETG. The acronym PETG may refer to a glycol modified version of polyethylene terephthalate. PETG may be commercially available from a variety of commercial suppliers, such as from Piedmont Plastics as marketed under the name "PETGCLR". Generally, PETG may have advantageous material properties for the purpose of constituting a transparent facemask unibody—such as excellent clarity, good impact strength, and meeting various materials requirements related to being in contact with human skin.

In other embodiments, other clear thermoplastic polymers may be used to constitute the facemask unibody 202. For example, polycarbonate polymers may be used. Generally, polycarbonate refers to a class of polymers which include carbonate groups in their chemical structures. Polycarbonates generally may be a strong, tough polymer material. In some embodiments, only polycarbonates that are transparent and have a suitably low glass transition temperature may be used to form the facemask unibody 202.

In another embodiment, a TPE polymer may be used to form the facemask unibody 202. TPE may generally refer to a thermoplastic elastomer—which, as is generally known, may refer to any of a variety of copolymers or physical mixtures of polymers that consist of materials with both thermoplastic and elastomeric properties. TPEs may include thermoplastic polyurethanes, thermoplastic polyam ides, thermoplastic copolyester, and others. Generally, the polymer used to create the facemask unibody may be of any suitable transparent thermoplastic meeting the criteria discussed above.

In some embodiments, facemask unibody 202 may merely include the clear thermoplastic polymer. In other embodiments, facemask unibody 202 may consist essentially of the thermoplastic polymer—containing no other ingredients other than the clear thermoplastic polymer that would materially affect the basic properties of the clear thermoplastic polymer. In yet other embodiments, facemask unibody 202 may consist of the thermoplastic polymer—containing no other ingredients other than the clear thermoplastic polymer itself.

FIG. 2C shows facemask unibody 202 by itself as one continuous piece that includes first filter cavity 204 as shown. First filter cavity 204 may include airflow holes 206, 208, 210, and 212 as discussed above. First filter cavity 204 may also include first filter frame cavity 238. First filter frame cavity 238 may be configured to accept first filter frame 232 on first filter 230. In this way, first filter 230 may snap into place inside first filter cavity by being inserted into first filter frame cavity 238 past first filter snap-in ridge 236 (previously discussed with respect to FIG. 2B). First filter 230 is therefore removable from facemask unibody 202 as indicated in FIG. 2C, yet also forms an airtight seal when inserted therein. This configuration may advantageously allow retention of the filter 230 within facemask 200, without the need for other adaptors or additional retaining components. Filter 242 may be symmetric to filter 230.

Figure 2D:
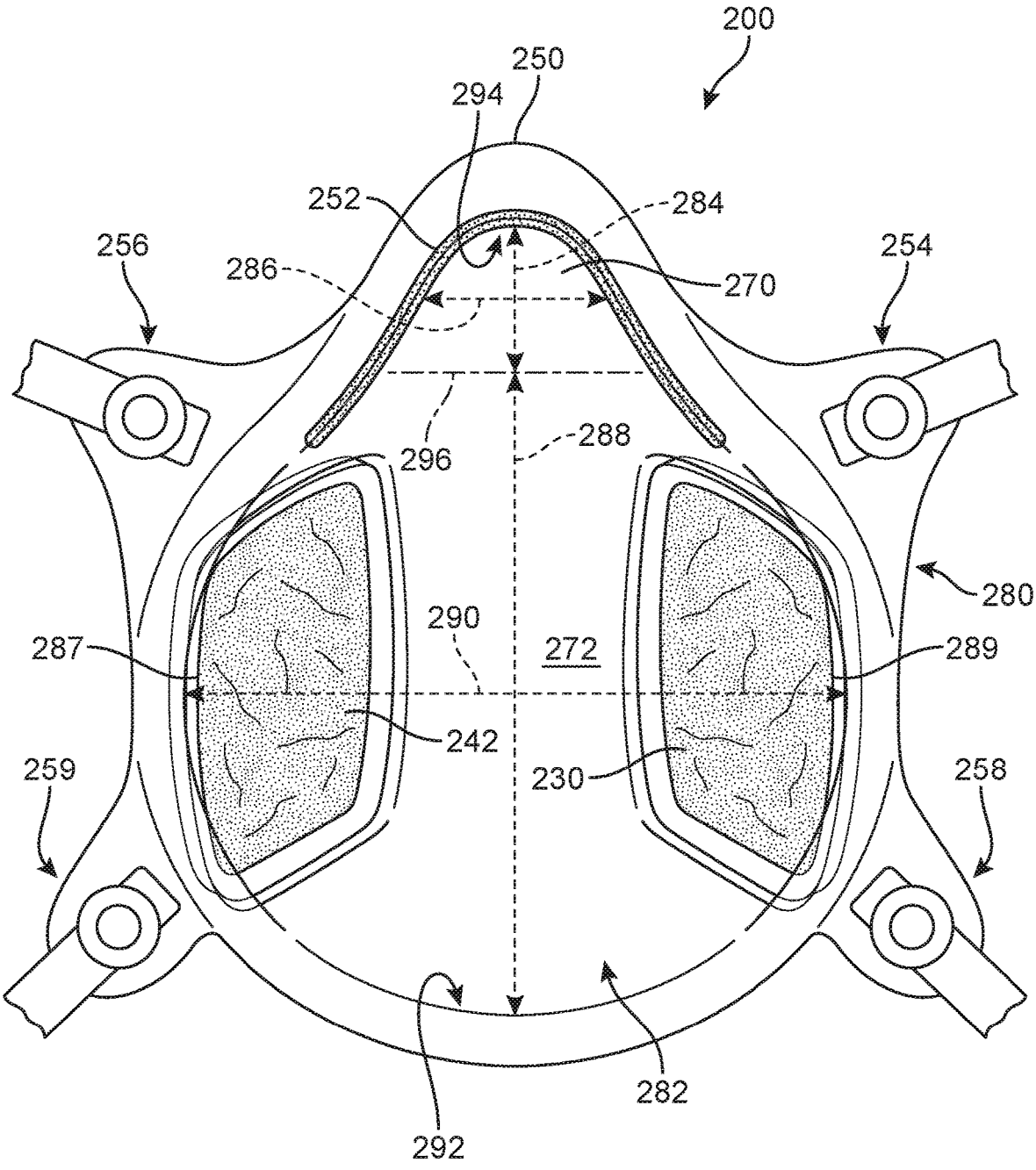
FIG. 2D is a rear view of the second facemask.

FIG. 2D shows a rear view of facemask 200. This view shows inner side 282 of facemask 200. Inner side 282 of facemask may be the side on which first filter 230 and second filter 242 are disposed, as shown in FIG. 2C. Each filter may therefore cover the airflow holes (206, 208, 210, 212 etc.) on an inner side 282 of facemask 200. In this view, various dimensions of facemask 200 may be illustrated.

Namely, facemask 200 may include a mouth region 272 that corresponds to a wearer's mouth area when worn. Mouth region 272 may include mouth vertical distance 288 that extends from a bottom of the facemask 292 to a bottom 296 of a nose region 270. Mouth region 272 may also include a mouth horizontal distance 290 that extends laterally across the facemask 200 from a first lateral side cheek area 287 to a second lateral side cheek area 289.

Facemask 200 as shown in FIG. 2D may also include nose region 270. Nose region 270 may have nose vertical distance 284 that extends from bottom 296 of nose region to top 294 of facemask 200. Nose region 270 may also have nose horizontal distance 286 that extends from one side of the facemask 200 to another.

These distances (284, 286, 288, 290) may be adjusted during a customization process, as discussed variously below.

In this way, facemask 200 as shown in FIG. 2D extends vertically with a total height (288 and 284) such that the facemask 200 covers the wearer's mouth from below the chin, and covers the wearer's nose up to a bridge of the nose. The facemask also extends horizontally with a total width (290) such that facemask 200 covers the wearer's face from a midpoint on one cheek laterally across to a midpoint on the other cheek.

Figure 3A:
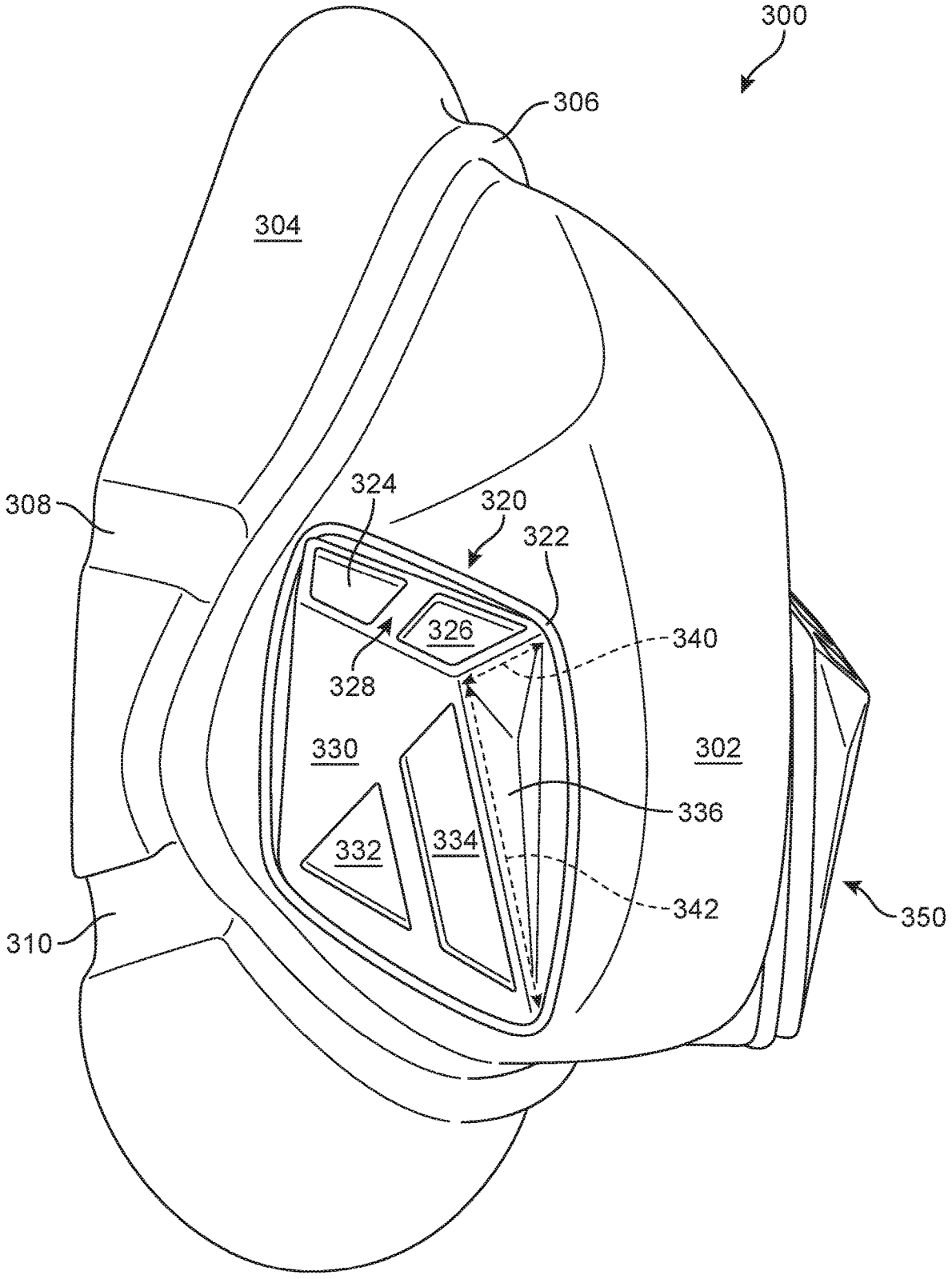
FIG. 3A is a side isometric view of a mold used to generate a facemask unibody for the second facemask.

FIG. 3A shows a mold 300 that may be used to produce a facemask unibody such as facemask unibody 202 variously shown in FIG. 2A-2D and discussed above. Mold 300 may include a mold main body portion 302 that corresponds to a nose region and mouth region in a facemask unibody. Mold 300 may also include a base portion 304 that may hold mold 300 in place during manufacturing, but does not receive a polymer sheet thereon.

Mold 300 may next include lip portion 306 between main body portion 302 and base portion 304. Lip portion 306 may correspond to an outer rim tab in a finished facemask unibody. Mold 300 may also include attachment tab cutouts 308 and 310, that may correspond to respective attachment tab areas on the facemask unibody where straps will be attached.

First mold pod 320 and second mold pod 350 may be located on symmetric sides of mold 300. Each mold pod may correspond to a filter cavity. Namely, first mold pod 320 may correspond to a first filter cavity. Included on first mold pod 320 may be first depression area 324, second depression area 326, third depression area 332, and fourth depression area 334. Each of the depression areas may correspond to an airflow hole, as shown further in FIG. 8. First depression area 324 and second depression area 326 may be located on top surface 328 of mold pod 320, while third depression area 332 and fourth depression area 334 may be located on outer surface 330 of mold pod 320. Mold pod 320 may have depth 340 adjacent to top surface 328, and depth 340 may taper to a substantially negligible depth along length 342.

FIG. 3A also shows mold filter cavity ring 322. Mold filter cavity ring 322 may surround mold pod 320 and may create a filter ring cavity in the facemask unibody, such that a filter frame may be securely and reversibly held within facemask unibody 202.

Figure 3B:
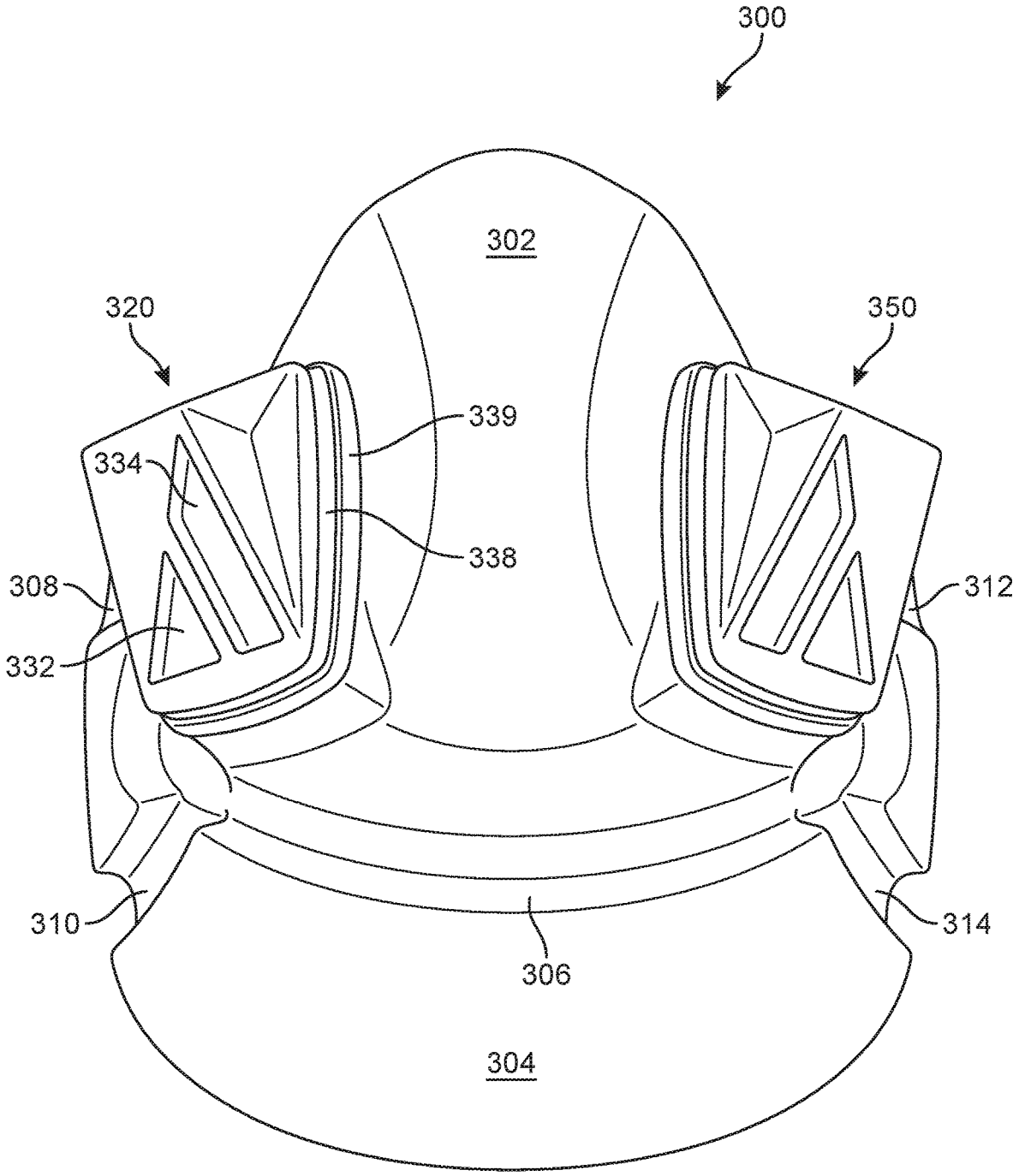
FIG. 3B is bottom isometric view of the mold used to generate the second facemask unibody.

FIG. 3B shows mold 300 from a bottom isometric view. However, in FIG. 3B mold 300 does not include mold filter cavity ring 322. Instead, FIG. 3B illustrates how mold filter cavity ring 322 would sit in groove 338 at the base of mold pod 320. Mold filter cavity ring 322 may therefore, in some embodiments, be a separate mold piece from mold pod 320. Mold filter cavity ring 322 may therefore create the positive space within the facemask unibody created from mold 300 for a filter frame cavity.

Also shown in FIG. 3B is mold portion 339 disposed adjacent to mold pod 320. Mold portion 339 may correspond to a snap-in ridge as discussed above, that may be configured to retain a filter frame within a filter cavity. Mold portion 339 may be configured to this end by being slightly smaller in each perimeter direction than mold filter cavity ring 322.

Figure 3C:
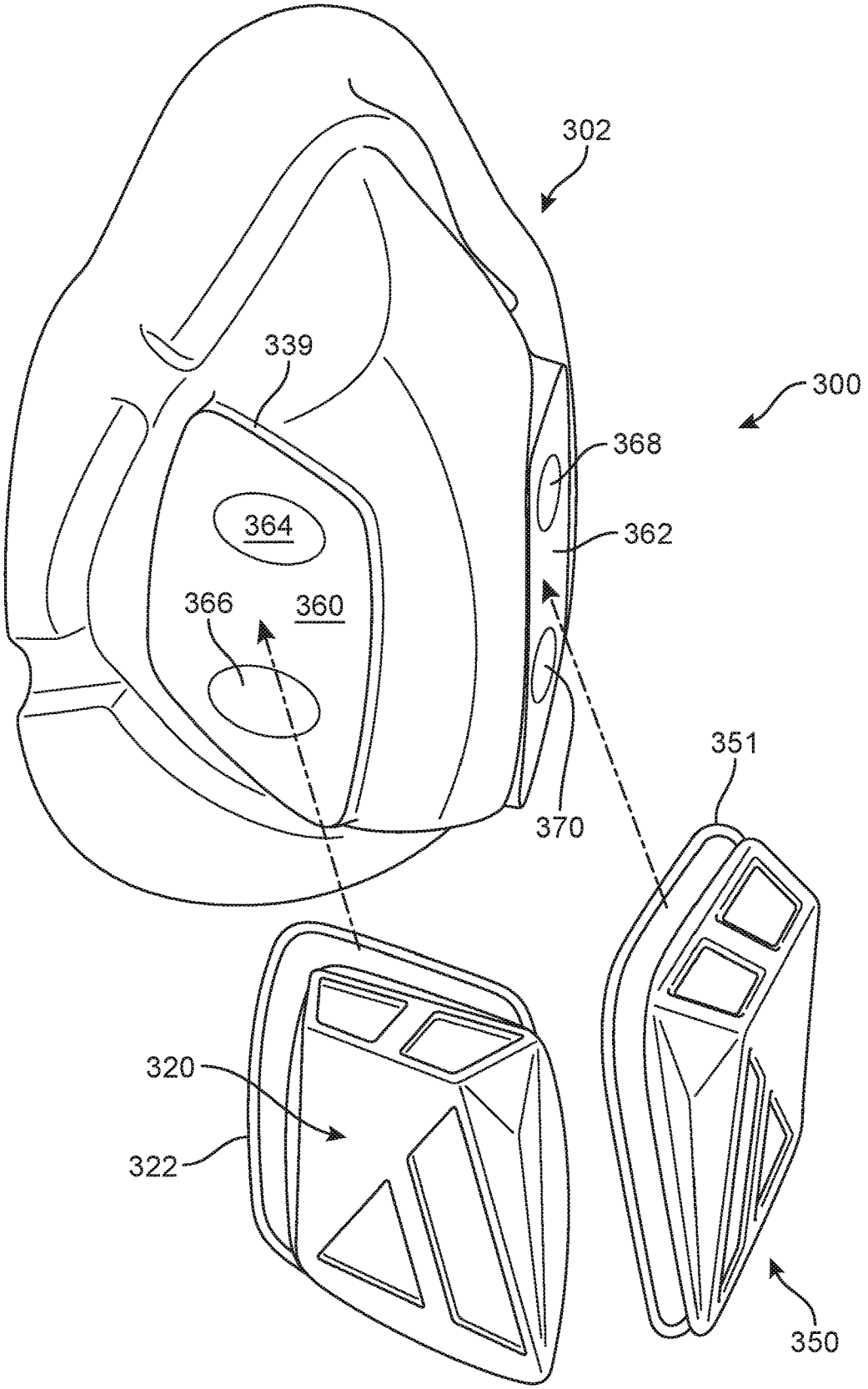
FIG. 3C is an exploded isometric view of several pieces of the mold used to generate the second facemask unibody.

The several sub-components making up mold 300 are further shown in FIG. 3C. Namely, mold 300 may be comprised of mold main body portion 302, first mold pod 320, first mold filter cavity ring 322, second mold pod 350, and second mold filter cavity ring 351. Mold filter cavity ring 322 may be retained on mold pod 320 in groove 338 as mentioned. Mold pod 320 may then be retained on mold main body portion 302 through the use of attachment slots 364 and 366.

Namely, FIG. 3C shows how mold main body portion 302 may include mold pod receiving area 360. Mold pod receiving area 360 may be substantially flat, and may generally include one or more attachment slots 364/366. An attachment post (not shown in FIG. 3C, discussed below with respect to FIG. 7A) on mold pod 320 may be inserted into attachment slots 364/366 to reversibly join the mold pieces for use in molding. Similarly, second mold filter cavity ring 351 may be retained on second mold pod 350—and then second mold pod 350 may be retained on mold main body portion 302 by attachment slots 368 and 370 on second mold pod receiving area 362.

Mold 300 may therefore be a five piece multi-part mold that may be use for thermoforming a polymer sheet thereon. This configuration of mold 300 may be used to achieve the described configuration of a facemask unibody, despite the existence of undercuts that would otherwise prevent mold release. Namely, a single piece mold having the shape of mold 300 would not allow for release of the formed facemask unibody from the mold—due to the shape of the mold pods having undercuts relative to the main body area of the facemask unibody. Therefore, during manufacturing, mold 300 may release a facemask unibody in two steps: first release of the facemask unibody from mold main body portion 302, taking the mold pods 320/350 and associated mold filter cavity rings 322/351 inside the released facemask unibody as retained inside the filter cavities—and then secondly, removal of the mold pods 320/350 and associated mold filter cavity rings 322/351 from the otherwise already released facemask unibody. This two step release process allows full removal of the mold without the any need to deform the facemask unibody or otherwise change the shape of the molded facemask unibody to avoid undercuts.

Figure 3D:
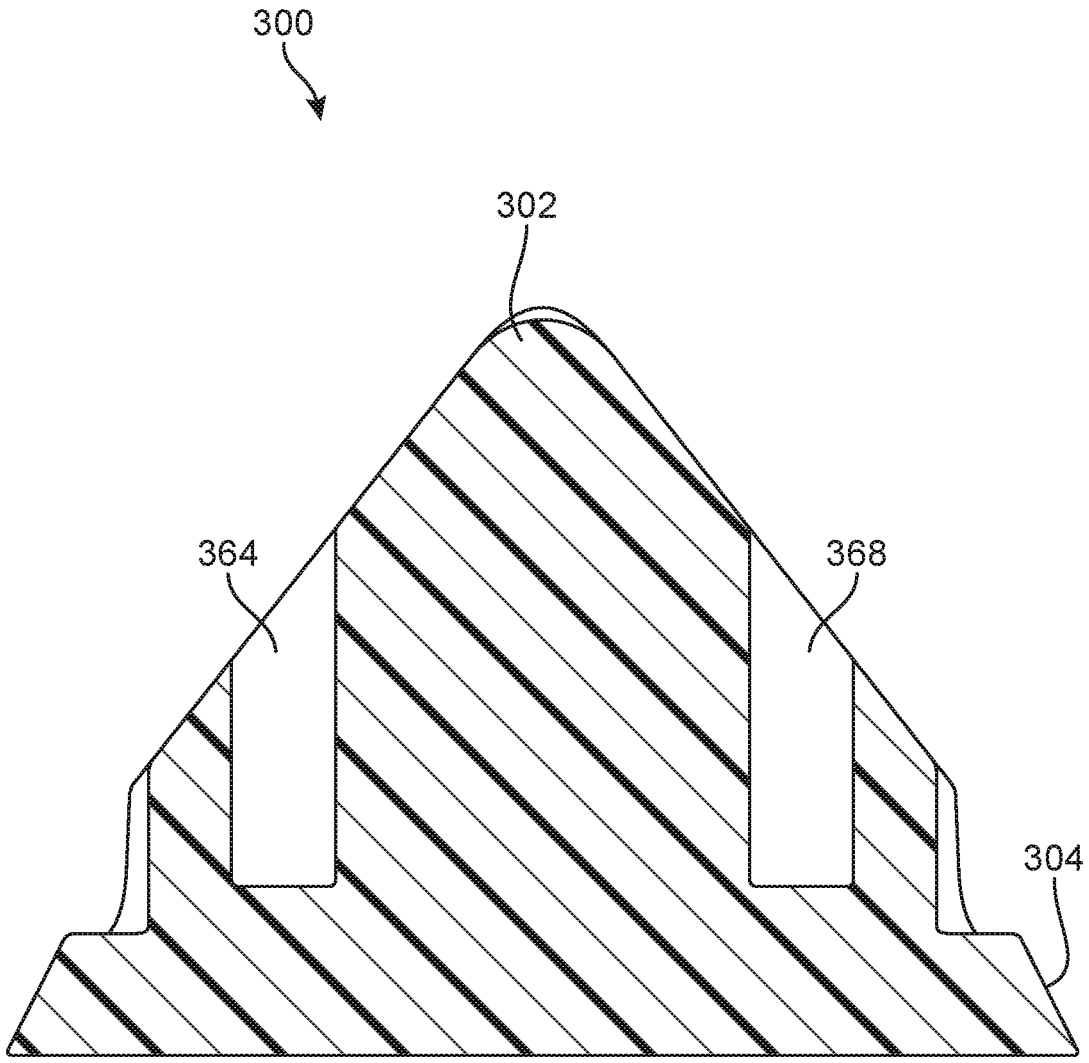
FIG. 3D is a cross-sectional view of the mold used to generate the second facemask unibody.

FIG. 3D shows a cross-sectional view of mold 300. This view shows attachment slots 364 and 368 in greater detail. Namely, FIG. 3D shows a horizontal cross section of mold main body portion 302 at a vertical position corresponding to the location of attachment slots 364 and 368. Attachment slots 364 and 368 may extend downward into mold main body portion 302 as shown, so as to allow for reversible attachment of the mold pods as discussed above.

Figure 4A:
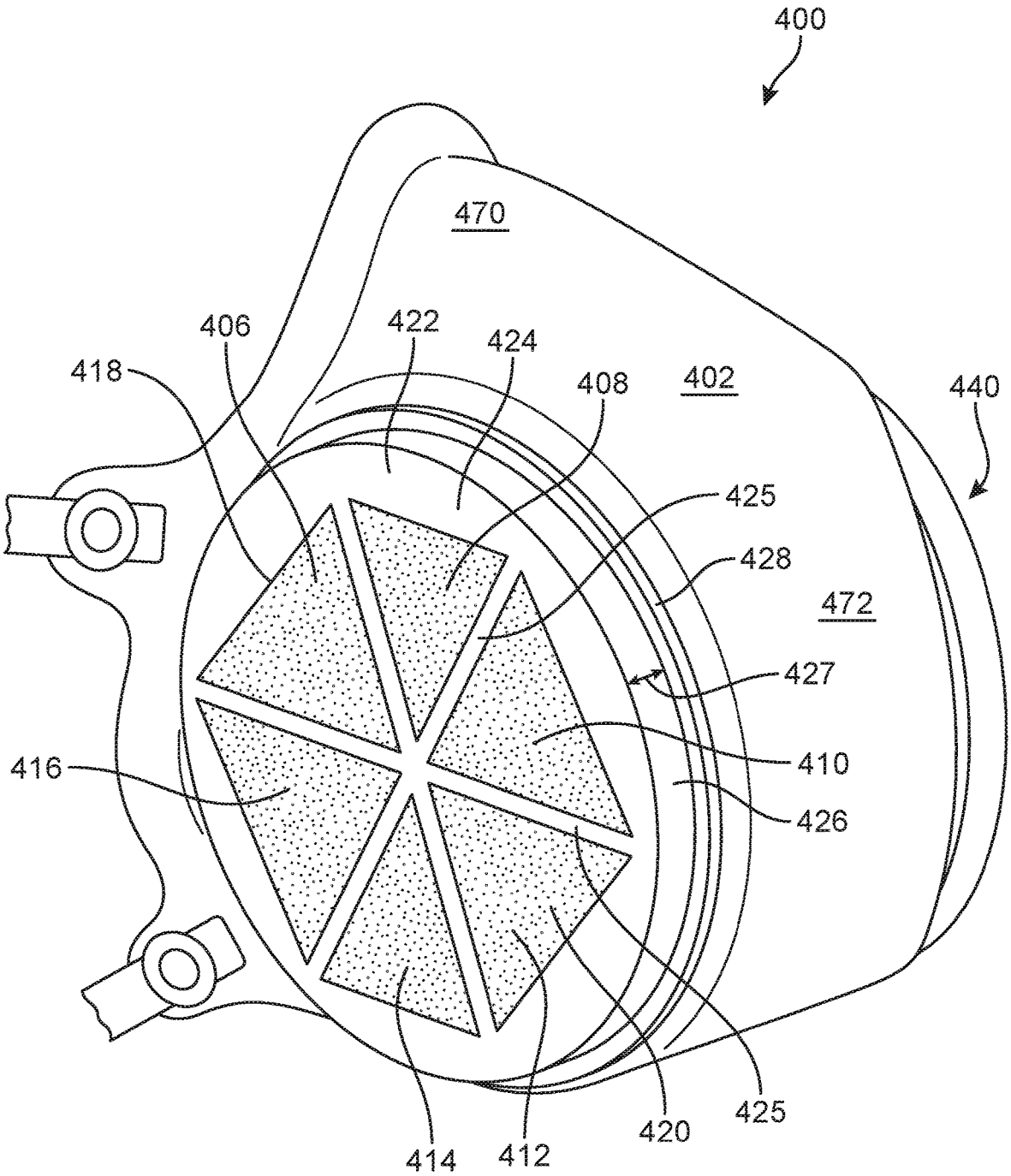
FIG. 4A is a side isometric view of a third embodiment of a facemask in accordance with this disclosure.

Next, FIG. 4A shows a third embodiment of a facemask 400 within the scope of this disclosure. Facemask 400 may include a filter adaptor 422 that removably holds a filter 420 onto facemask 400. Filter adaptor 422 may be located on facemask body 402 on a lateral side, so that a wearer's mouth may be visible through mouth area 472.

Filter adaptor 422 may include a plurality of airflow holes 418 therein on a top surface 424, so that airflow may pass through filter 420 as it travels from an outer side of the facemask 400 into the facemask 400. Namely, first airflow hole 406, second airflow hole 408, third airflow hole 410, fourth airflow hole 412, fifth airflow hole 414, and sixth airflow hole 416 may each be separated from each other by support structures 425 on top surface 424.

Filter adaptor 422 may also include sidewall 426 that extends perpendicularly to top surface 424. Sidewall 426 may have a sufficient height 427 so that filter adaptor 422 may contain filter 420 therein. However, in some embodiments, sidewall 426 may also have the smallest height 427 necessary to contain filter 420 therein. Filter adaptor 422 may also include outer rim 428. Outer rim 428 may extend perpendicularly from sidewall 426 along a circumference of filter adaptor 422.

In some embodiments, filter 420 may be a filter having the N95 industry designation. The N95 designation, as is generally known in the facemask industry, was created and is maintained by the National Institute for Occupational Safety and Health (NIOSH). The "N" designation refers to not being resistant to oils, and the "95" designation refers to the ability to filter at least 95% of airborne particles. A N95 filter may be made from a fine mesh of synthetic polymer fibers, such as a nonwoven polypropylene fabric. Filters having the N95 designation may be commercially available from a variety of suppliers, such as 3M.

Facemask 400 may also include second filter adaptor 440 on a laterally symmetric side from first filter adaptor 422. Second filter adaptor 440 may otherwise be substantially similar to filter adaptor 422.

Figure 4B:
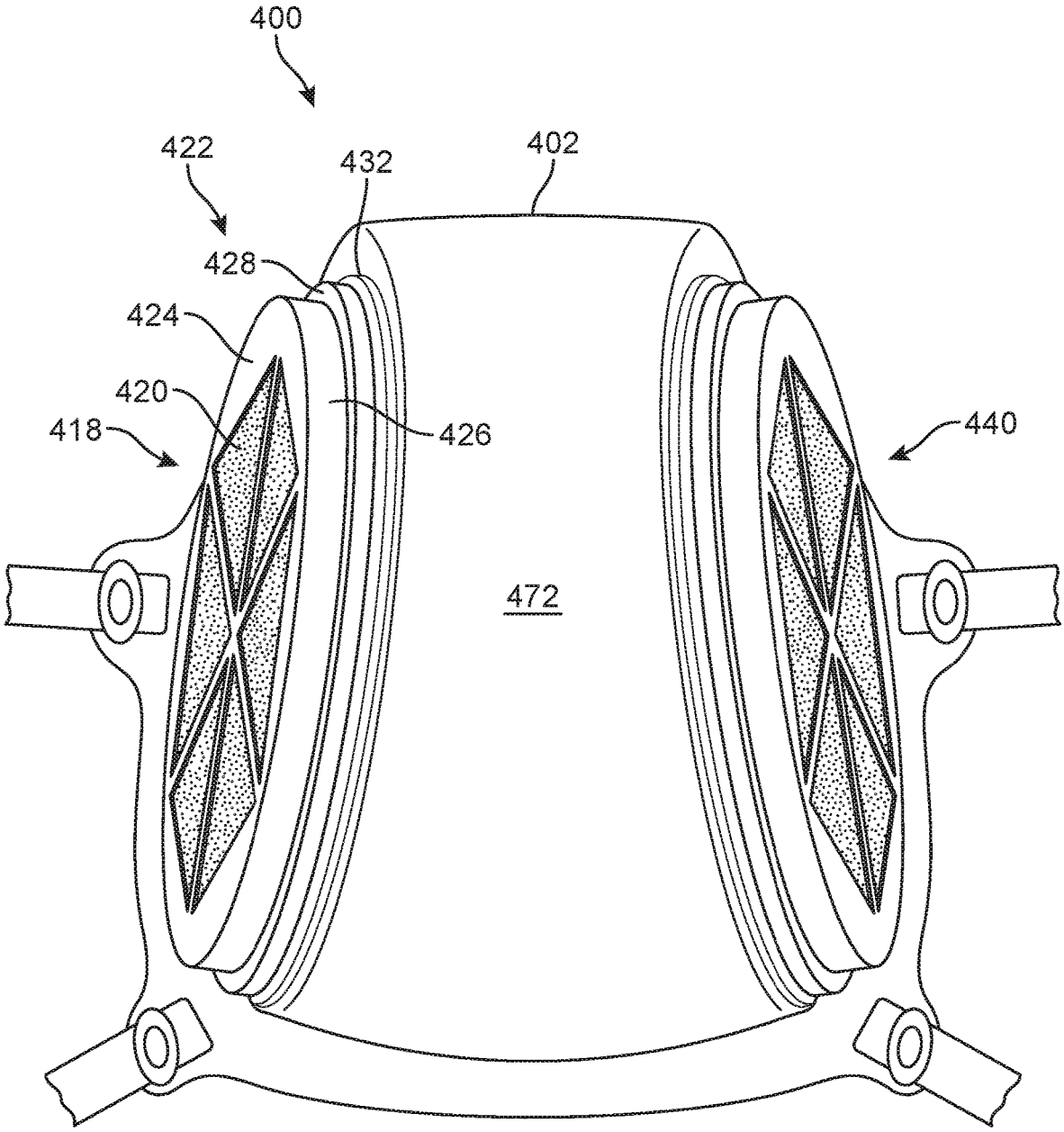
FIG. 4B is a bottom isometric view of the third facemask.

FIG. 4B shows a bottom view of facemask 400, and both first filter adaptor 422 and second filter adaptor 440. FIG. 4B shows how each of the filter adaptors 422/440 may be located on facemask 400 so that mouth region 472 may be unobstructed. Instead, each of the filter adaptors 422/440 may be located in a region of facemask 400 corresponding to a respective one of the wearer's cheeks. As discussed above, a facemask such as facemask 400 that is both transparent and leaves the wearer's mouth unobstructed may advantageously aid in interpersonal communication as compared to facemasks that obscure the wearer's mouth and lips.

Also shown in FIG. 4B is how an inner rim 432 on an inner side of the facemask unibody 402 may be disposed adjacent to an outer rim 428 on an outer side of the facemask unibody 402. Inner rim 432 and outer rim 428 may act to sandwich the facemask unibody 402 between them, so as to hold filter adaptor 422 and filter 420 in place on facemask 400.

Figure 4C:
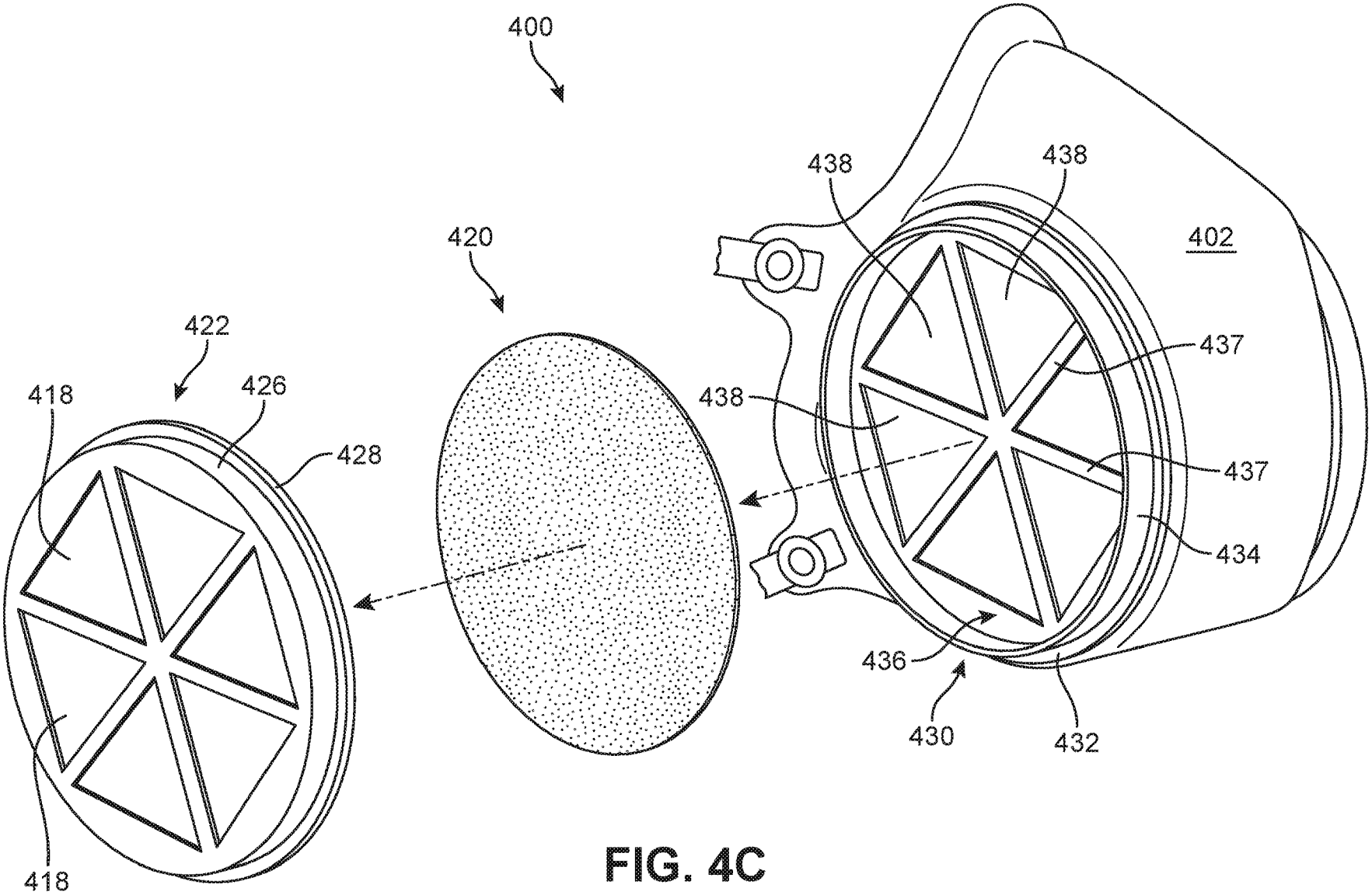
FIG. 4C is an exploded view of the third facemask, showing the filter and filter adaptors.

Namely, FIG. 4C shows facemask 400 with the filter adaptor in greater detail. A filter adaptor may be comprised of an outer filter adaptor 422 and an inner filter adaptor 430. Filter 420 may then be housed between inner filter adaptor 430 and outer filter adaptor 422. In particular, inner filter adaptor 430 may include inner rim 432 located on an inner side of facemask unibody 402. That is, inner rim 432 may be located adjacent to an inner surface of facemask unibody 402. Inner rim 432 may also extend parallel to an inner surface of facemask unibody 402, and be securely attached to inner surface of facemask unibody 402. The secure attachment between inner rim 432 and inner surface of facemask unibody 402 may be by e.g. gluing, welding through partial melting of a component of facemask 400, or other physical attachment means.

Further, facemask unibody 402 may include one large airflow hole through which inner filter adaptor 430 extends. Namely, inner filter adaptor 430 may include inner filter adaptor sidewall 434 that extends laterally outward through the one large airflow hole in facemask unibody 402. Inner filter adaptor then may include plurality of holes 438 that are created by inner hole support structures 437 between them. Plurality of inner adaptor holes 438 may correspond to plurality of outer adaptor holes 418. In this way, outer filter adaptor 422 and inner filter adaptor 430 may allow airflow to pass through filter 420 to enter and exit facemask 400.

The respective sidewalls and rims of each of the filter adaptors may be configured to engage with each other, so as to seal the filter 420 between the inner filter adaptor 430 and the outer filter adaptor 422. Namely, inner filter rim 432 may extend parallel with a portion of the facemask unibody 402 on an inner side, and outer filter rim 428 may extend parallel with the same portion of the facemask unibody 402 on an outer side of facemask unibody 402. Inner filter adaptor sidewall 434 may be configured so that outer filter adaptor sidewall 426 engages with inner filter adaptor sidewall 434, such as by being snugly adjacent to it so as to create an airflow seal. In this way, filter 420 may securely cover all of the plurality of inner holes 438 and plurality of outer holes 418 so that the filter 420 completely covers an airflow hole in the facemask unibody 402.

Figure 4D:
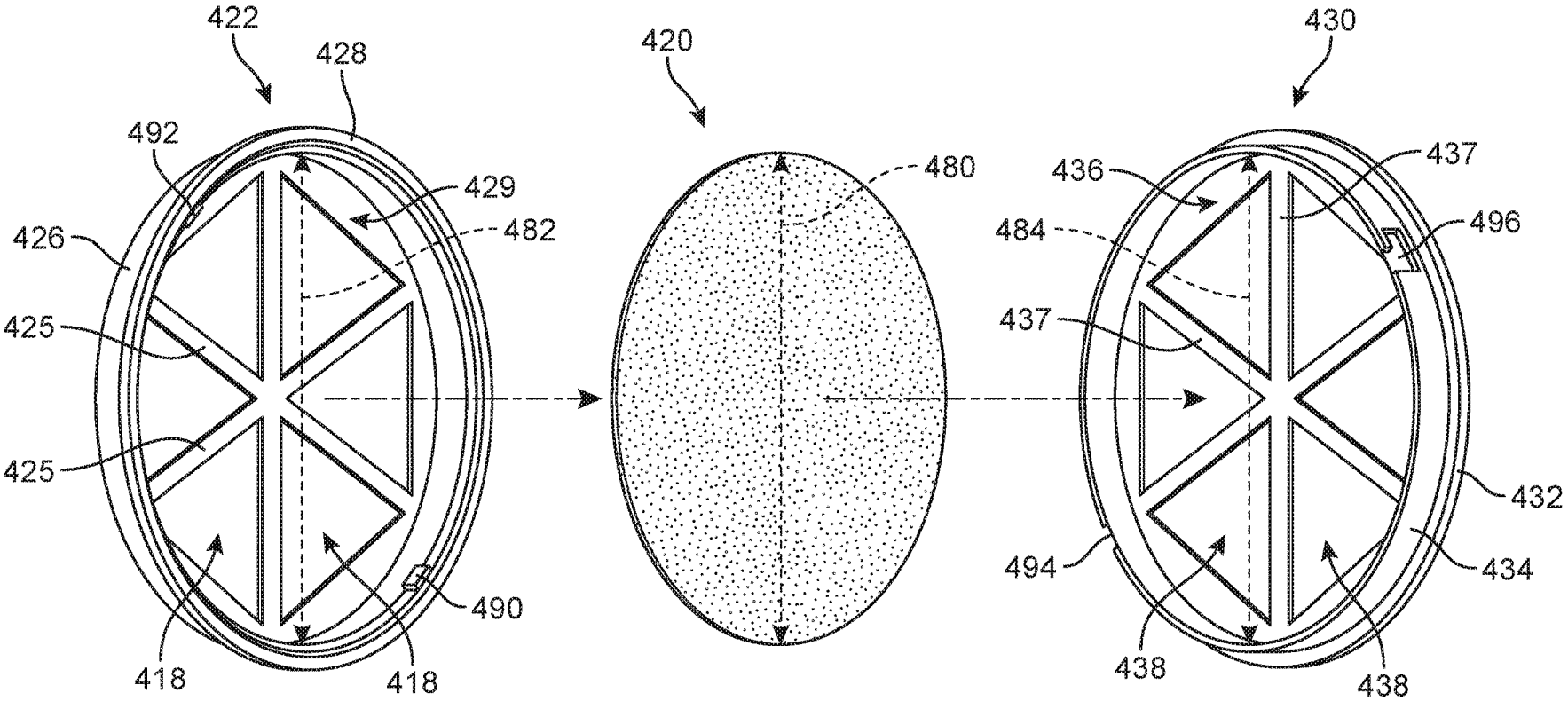
FIG. 4D is an exploded view of the filter and filter adaptors used in the third facemask.

FIG. 4D shows additional details of how inner filter adaptor 430 and outer filter adaptor 422 may reversibly engage with each other. Namely, inner filter adaptor 430 may include at least one notch 494/496 on an outer side of inner adaptor sidewall 434. Outer filter adaptor 422 may then include at least one corresponding tongue 490/492 on an inner side of outer filter adaptor sidewall 426. Tongue 490 may engage with notch 494, and tongue 492 may engage with notch 496. Then, upon rotating outer filter adaptor 422, each tongue 490/4992 may reversibly lock in place into each respective notch 494/496. In this way, filter 420 may snugly but reversibly be held between the two filter adaptors so as to filter any airflow entering or exiting the facemask 400.

Additionally, FIG. 4D shows how each of the filter adaptors may be sized to achieve an airtight seal with the filter 420. Namely, inner filter adaptor 430 may have first diameter 484. First diameter 484 may be only slightly larger than second diameter 480 of filter 420. Then, outer filter adaptor 422 have third diameter 482 that is larger than first diameter 484 by the thickness of inner filter adaptor sidewall 434. In this way, all three components may fit securely together to create an airtight seal.

As a result of this configuration, when in use in facemask 400, filter 420 may be adjacent to inner surface 436 on inner filter adaptor 430 and inner surface 429 on outer filter adaptor 422. Filter 420 may therefore be removed from facemask 400 by a user, without specialized tools or the use of other cumbersome mechanisms. This may allow the filter to be easily and conveniently replaced after use without needing to replace the entire facemask 400.

Figure 4E:
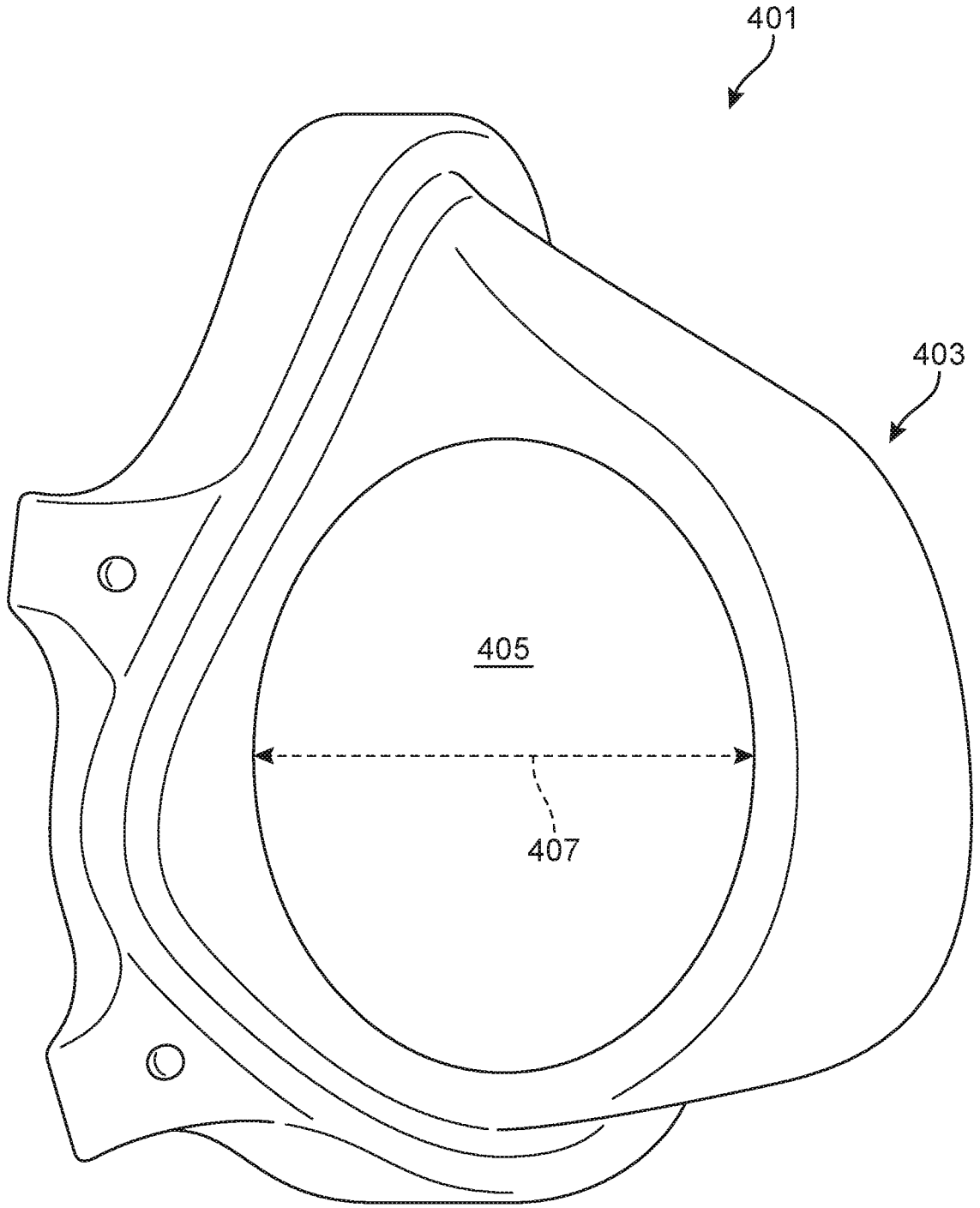
FIG. 4E is a mold used to generate a facemask unibody for the third facemask.

FIG. 4E shows a mold 401 that may be used to generate a facemask unibody 402 as discussed above. Mold 401 may generally be similar to mold 300 discussed above, except that airflow hole region 405 may be one large flat area of mold 300. Airflow hole region 405 may be on the side of mold mouth region 403. Airflow hole region 405 may have diameter 407 that may correspond to a diameter of an airflow hole that is subsequently removed from the molded facemask unibody in accordance with the manufacturing method discussed below with respect to FIG. 5.

Figure 4F:
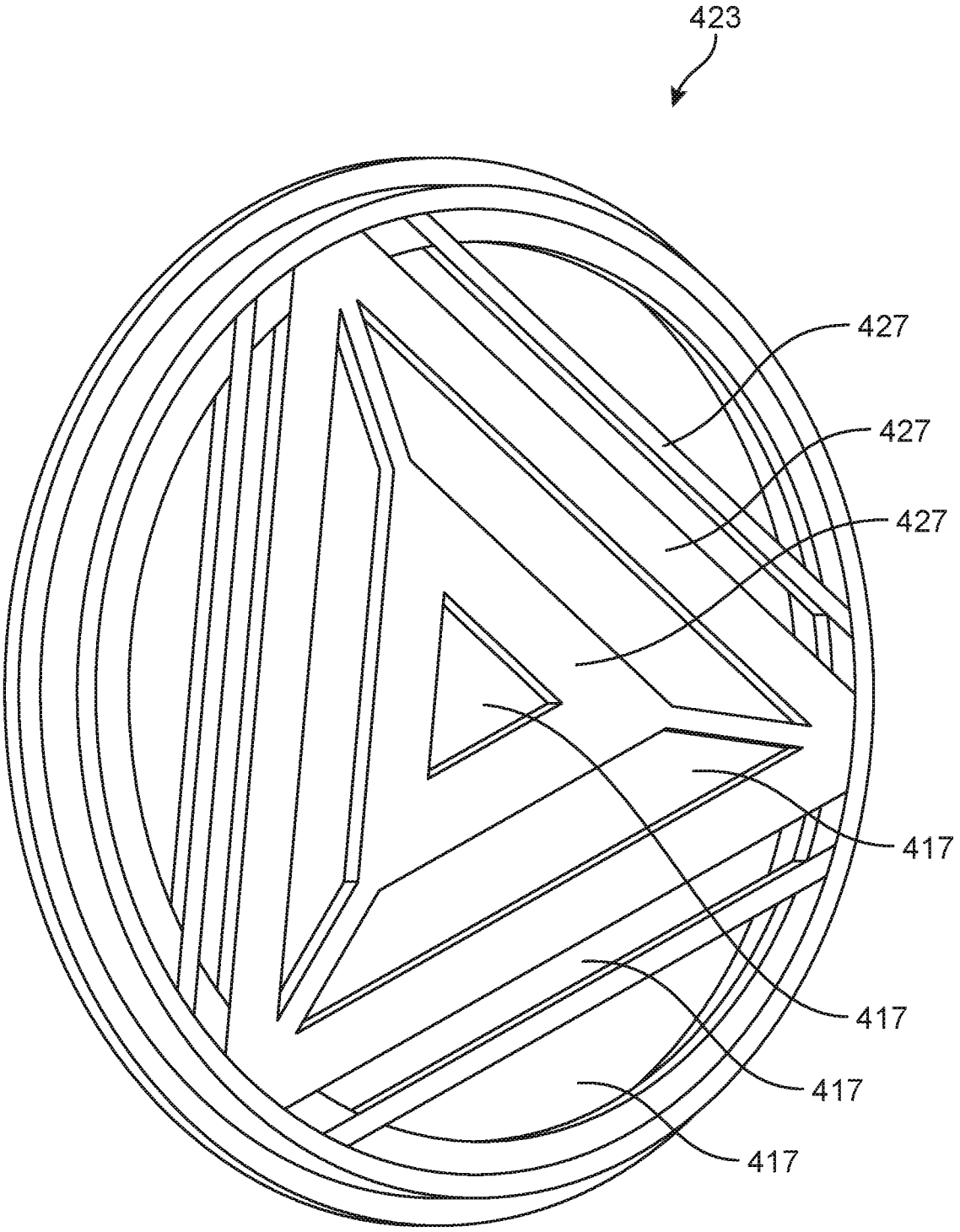
FIG. 4F is an isometric view of an alternate embodiment of a filter adaptor that may be used in the third facemask.

Finally, FIG. 4F shows an alternative embodiment of an outer filter adaptor 423. Outer filter adaptor 423 may be similar to outer filter adaptor 422, except that a configuration of holes 417 and support structures 427 may be as shown. Namely, outer filter adaptor 423 may include support structures 427 having a larger thickness than support structures 425 on outer filter adaptor 422—and support structures 427 may be arranged in a generally triangular arrangement as shown. This configuration may add advantageously dimensional stability and strength to outer filter adaptor 423.

Figure 5:
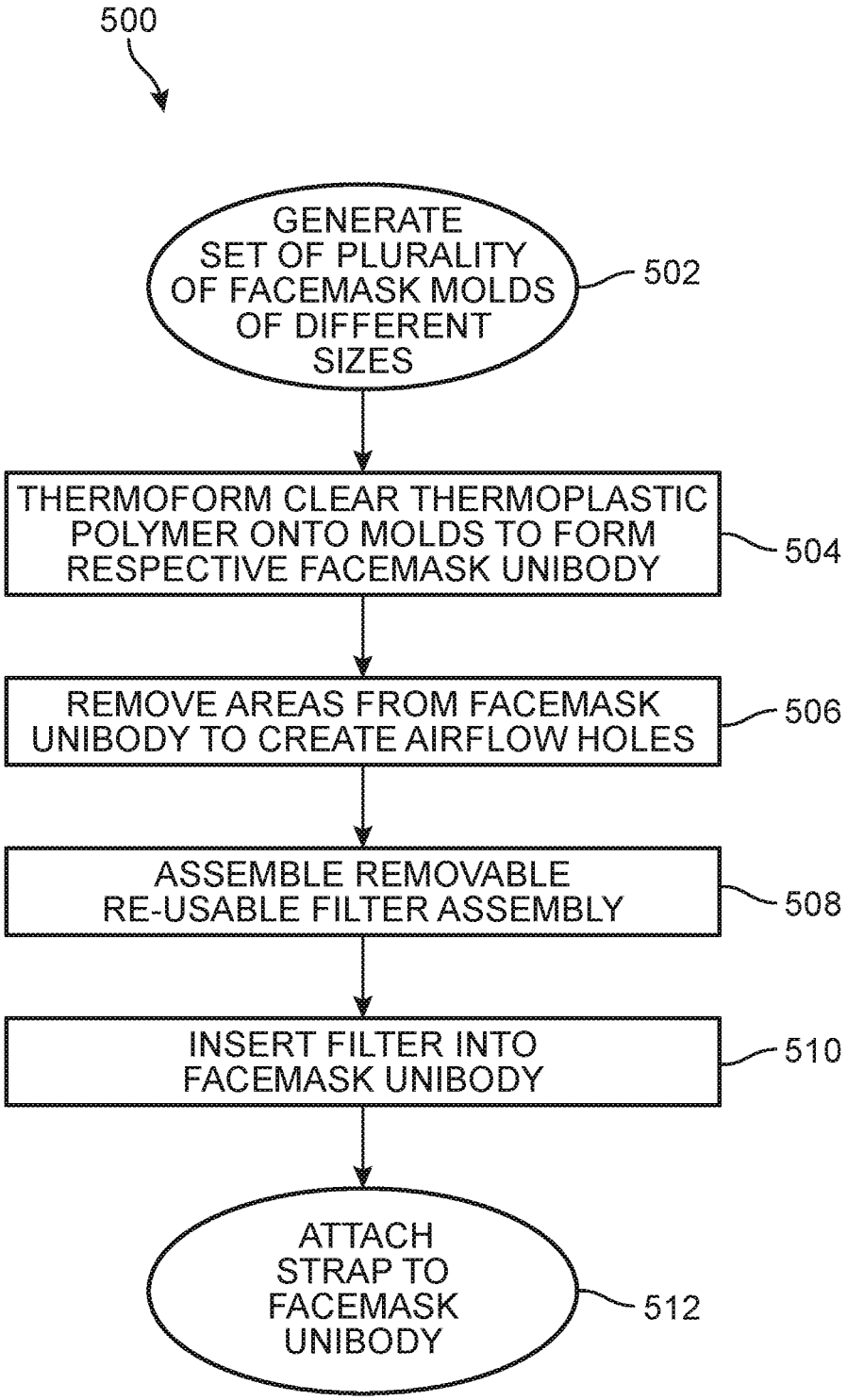
FIG. 5 is a flowchart showing a method of manufacturing a set of facemasks.

Next, FIG. 5 shows a flowchart of an embodiment of a method 500 of manufacturing a facemask. Broadly, FIGS. 6 through 9E all relate to the method 500 of manufacturing a facemask as shown in FIG. 5, and so are discussed concurrently with method 500.

Figure 6:
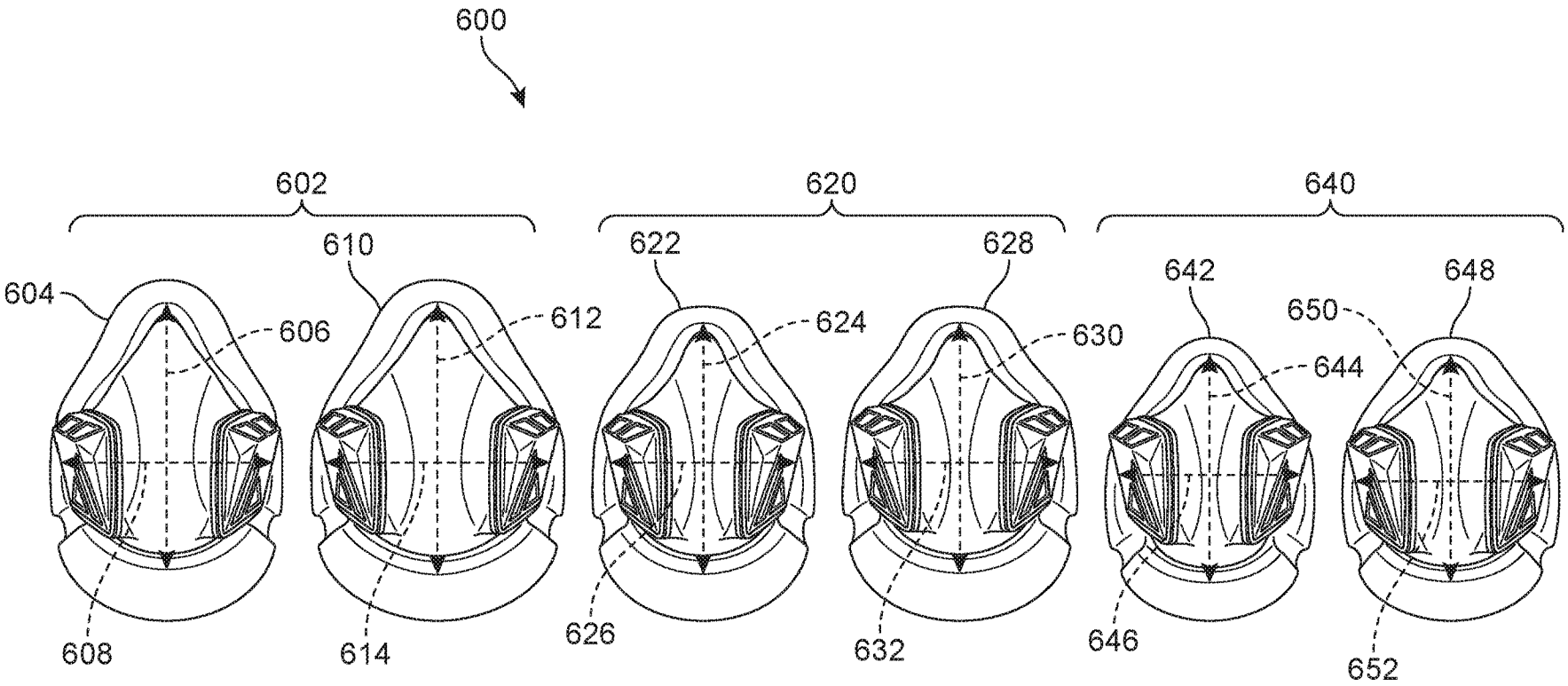
FIG. 6 is a set of plurality of facemask unibody molds, each differing in size.

First, in step 502, method 500 may include generating a set of a plurality of facemask molds of different sizes. One embodiment of such a set of a plurality of facemask molds is shown in FIG. 6. Generally, a facemask mold such as mold 300 or mold 401 may be generated by first designing the dimensions of the mold, and then making the mold through any of a variety of known manufacturing processes such as injection molding, or 3D printing.

The set of plurality of facemask molds 600 shown in FIG. 6 may include six facemask molds that each different from each other with respect to at least one dimension. However, in other embodiments, a set of a plurality of facemask molds may include any suitable number of differently sized molds.

In particular, the set of molds 600 shown in FIG. 6 may include a first mold 604 in "large—narrow" size. First mold 604 may have height 606 and width 608. Set 600 may next include a second mole 610 in "large—wide" size. Mold 610 may have height 612 that is substantially the same as height 606, and width 614 which is larger than width 608. First mold 604 and second mold 610 may be a subset 602 of "large" sized facemask molds.

Set of molds 600 may then include third mold 622 in "medium—narrow" size. Third mold 622 may have third height 624 that is less than height 612/60, and third width 626 that is less than first width 608. Fourth mold 628 may then be in "medium—wide" size. Fourth mold 628 may have fourth height 630 that is the same as third height 624, and fourth width 632 that is larger than third width 626. Third mold 622 and fourth mold 628 may be a subset 620 of "medium" sized facemask molds.

Set of molds 600 may then include fifth mold 642 in "small—narrow" size. Fifth mold 642 may have fifth height 644 that is less than third height 624, and fifth width 646 that is less than third width 626. Sixth mold 648 may then be in "small—wide" size. Sixth mold 648 may have sixth height 650 that is the same as fifth height 644, and sixth width that is larger than fifth width 646. Fifth mold 642 and sixth mold 648 may be a subset 640 of "small" sized facemask molds.

Generally, this set 600 of plurality of facemask molds may be configured to be used to generate facemasks according to the method of FIG. 5 that fit or are close to fitting a substantial proportion of a customer population. For example, by using such a set 600 of plurality of facemask molds having differing dimensions at least about 50% of a customer population may be fitted with a mask with only minimal additional customer customization (discussed below). In other embodiments, such a set 600 of plurality of facemask molds having differing dimensions may fit at least about 75% of a customer population with only minimal additional customization, or at least about 90%. Minimal additional customization may refer to changing any dimension of the facemask by less about 10%, or less than about 5%.

In some embodiments of a set of a plurality of facemask molds, such as is as shown in FIG. 6, each of the molds in the set may have the same filter cavity dimensions. Namely, each filter cavity area on each of the plurality of molds may have the same shape, with the same depth, width, and height. This may enable a standardized size of filter to be used in any of the plurality of sizes of facemasks generated from the set of molds. In this way, the set of facemasks may have interchangeable filters among themselves—thereby reducing cost and waste.

Once the set 600 of a plurality of facemask molds is generated at set 502, method 500 may proceed to step 504 of thermoforming a clear thermoplastic polymer sheet onto one or more of the molds to form a respective facemask unibody.

Figure 7A:
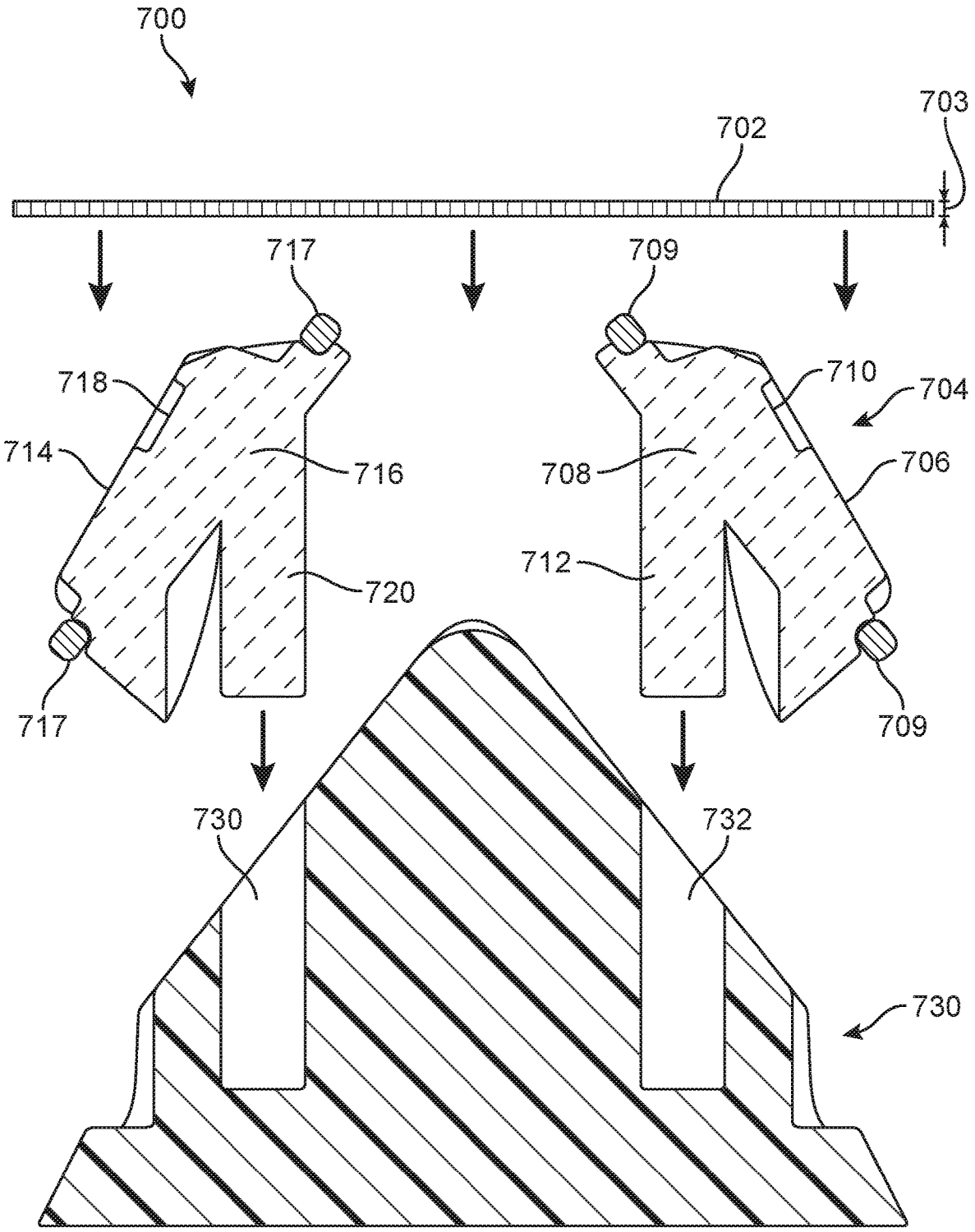
FIG. 7A shows a thermoforming process for manufacturing a facemask unibody using a facemask unibody mold.
Figure 7B:
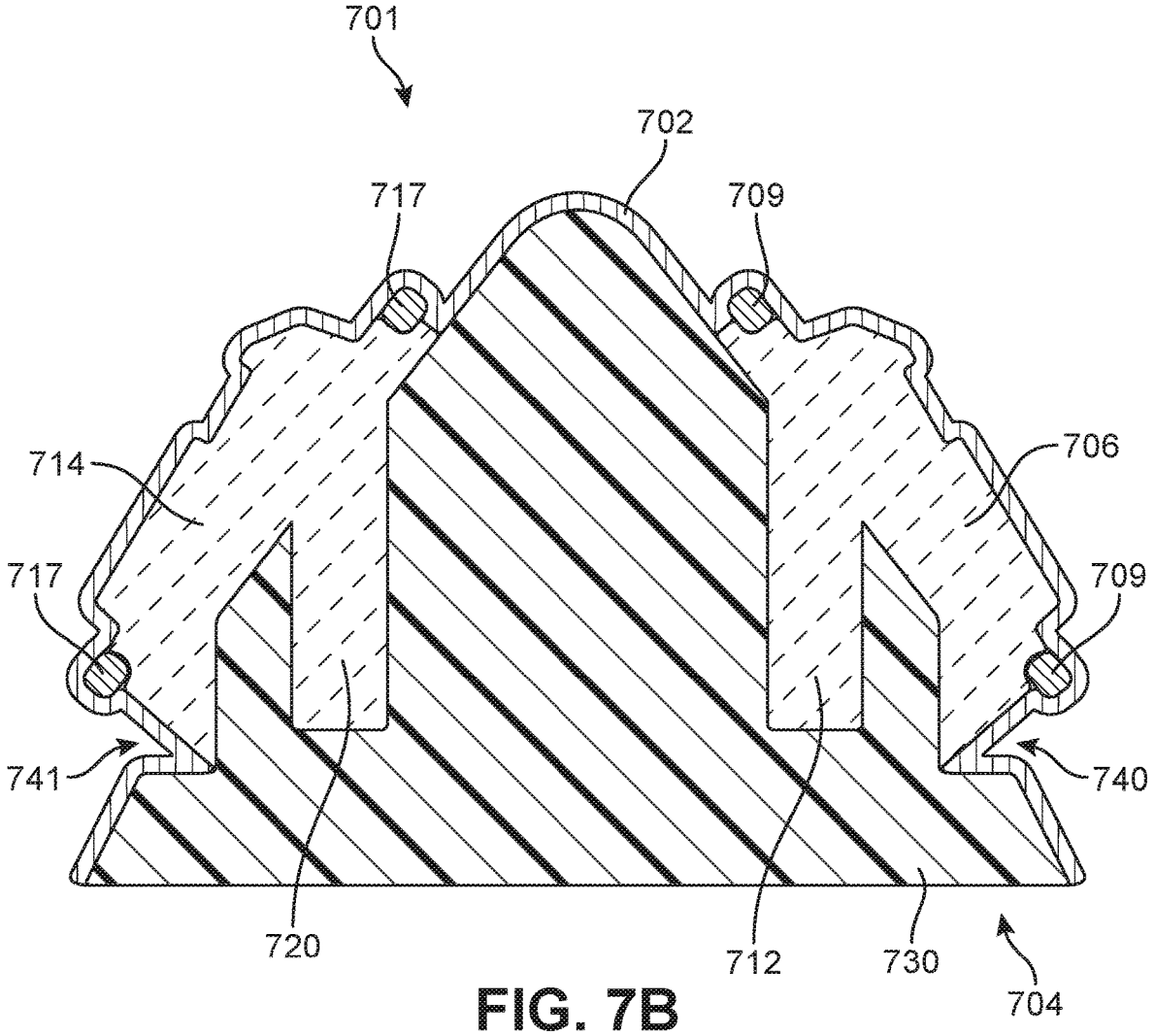
FIG. 7B further shows the thermoforming process for molding a facemask unibody onto the facemask unibody mold.

FIGS. 7A and 7B show one embodiment of this thermoforming process. As is generally known in the art, thermoforming is a manufacturing process where a plastic sheet is heated to a pliable forming temperature (that is, above its glass transition temperature), formed to a specific shape using a mold, and then trimmed to create a useable product. Thermoforming may broadly include vacuum forming, pressure forming, and mechanical forming. The various molds discussed herein may be male thermoforming molds.

Plastic sheet 702 may generally be any types of plastic that is clear and a thermoplastic. Several types of plastics are discussed above. In particular, sheet 702 may be PETG. That is, in various embodiments, sheet 702 may include PETG, or may consist essentially of PETG, or may consist of PETG. Additionally sheet 702 may have thickness 703, where thickness may be any suitable thickness that holds a facemask shape and is of an appropriate weight. In various embodiments, thickness 703 may be from about 0.25 mm to about 2 mm, or from about 0.5 mm to about 1.5 mm, or from about 0.5 mm to about 1.0 mm, or about 0.5 mm.

In some embodiments, plastic sheet 702 may have a thickness 703 and other material properties such that the facemask unibody manufactured therefrom may be semi-rigid. Generally, the clear thermoplastic polymer 702 may be substantially rigid at normal temperatures when in use as a facemask. A substantially rigid, or semi-rigid, facemask may be one that does not significantly deform or change shape in response to force applied by the strap to the user's face. A semi-rigid facemask may also be one that retains its shape before, during, and after normal usage on a wearer's face. In this way, a facemask in accordance with this disclosure may have a semi-rigid shape that covers the users mouth and nose when worn. More particularly, as discussed below with respect to FIG. 12, the facemask may have a first shape when provided to the user—and then the user may heat the facemask to a temperature above the glass transition temperature of the polymer and adjust the facemask into a second shape that better fits the user's face. The facemask may then substantially retain the second rigid shape while repeatedly being worn by the user. A substantially rigid shape may experience less than about 10% change in any given dimension, or less than about 5%, or less than about 2%, or less than about 1% during normal usage of the facemask.

FIG. 7A also shows a cross-sectional view of mold main body portion 730 and mold pods 706/714. Specifically, first mold pod 706 may include depression area 710 where polymer material will be trimmed to create an airflow hole. First mold pod 706 may also include first main section 708 and first attachment post section 712. First attachment post 712 may be configured to engage with attachment slot 732 on mold main body portion 730 so as to assemble the multi-piece mold together for thermoforming use. Situated on first mold pod 706 may be first filter cavity ring 709, used to create a space in the thermoformed facemask unibody where the filter frame will be situated.

Mold 704 may also include second mold pod 714. Second mold pod 714 may be symmetric with first mold pod 706. Namely, second mold pod 714 may include second depressed area 718 where an airflow hole will be cut after thermoforming, and second main portion 716, and second attachment post 720. Second attachment post 720 may engage with second attachment slot 730 on mold main body portion 730.

FIG. 7B shows the thermoforming process once the polymer sheet 702 has been formed onto the mold 704. Namely, as is known in thermoforming, sheet 702 takes on the shape of mold 704. This FIG. also shows how mold pods 706/714 engage with mold main body 730. As discussed above, mold 704 may be a five piece mold in order to ensure that undercuts 740 and 741 can be removed from the mold 704.

Figure 8:
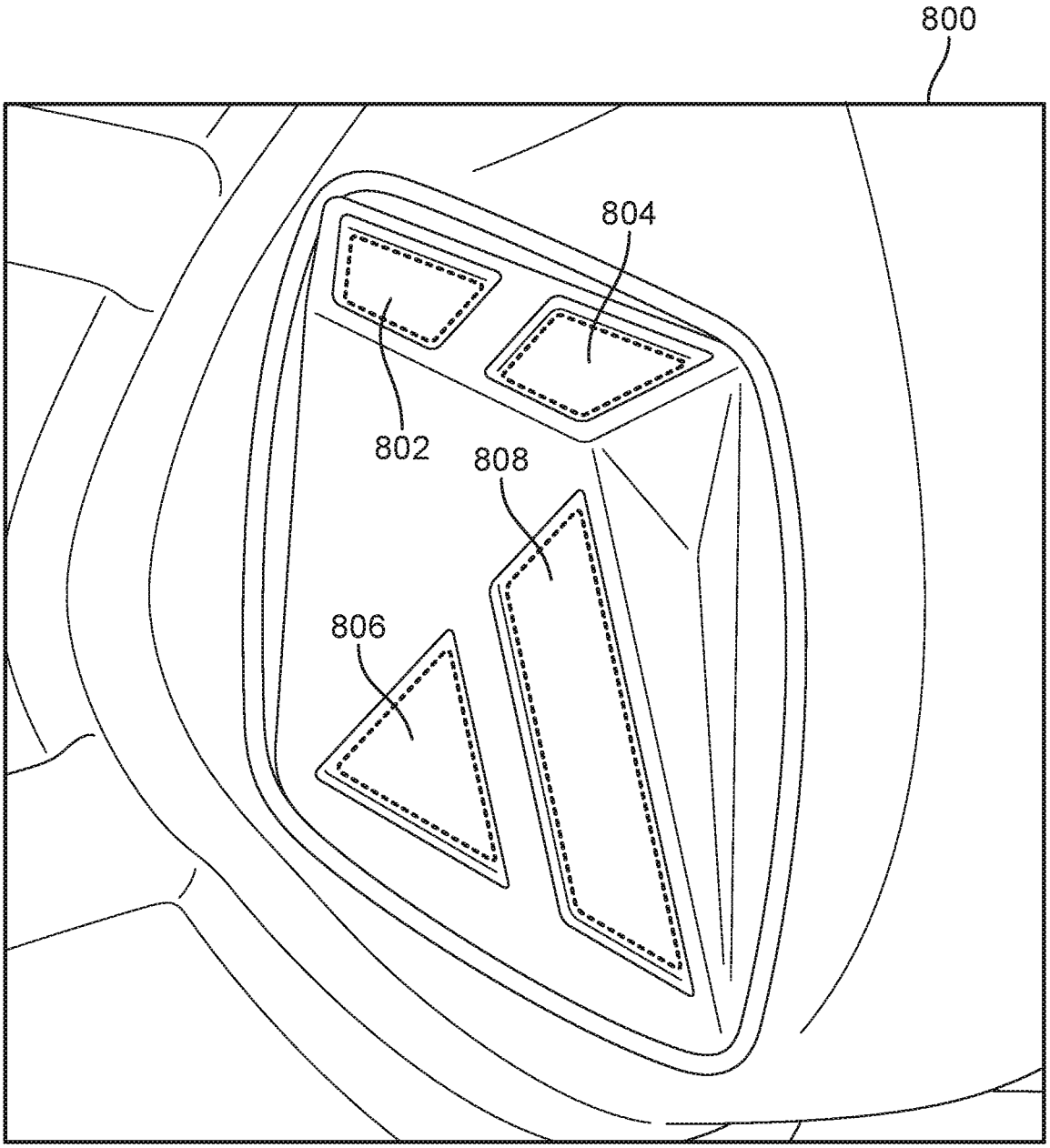
FIG. 8 shows an isometric view of a step of removing airflow holes in the molded facemask unibody.

Once removed from mold 704, a facemask unibody undergoes step 506 in method 500. Namely, the facemask unibody is trimmed to remove areas from the facemask unibody to create airflow holes. FIG. 8 shows this step 800 in some greater detail. Namely, areas 802, 804, 806, and 808 of may be removed from the formed sheet of polymer 702 in order to create airflow holes. The removal may be done through any of a variety of know processing techniques, such as die-cutting, punching, or removal with scissors or an exacto-knife or other tools. At the conclusion of step 506 in method 500, the facemask unibody may be ready to receive other components of the facemask.

Figure 9A:
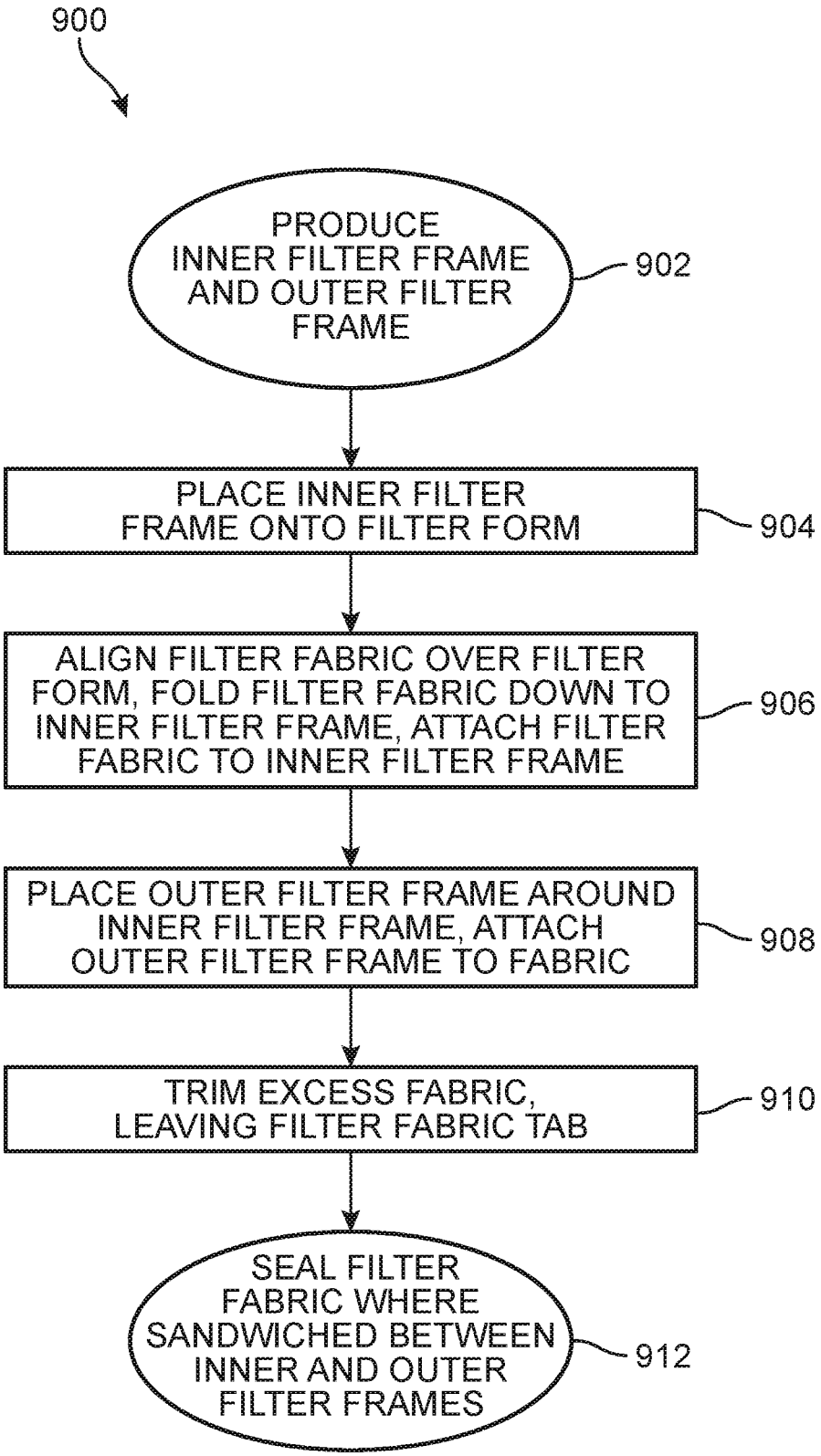
FIG. 9A is a flowchart showing a method of manufacturing a removable and re-usable filter for a facemask.

Namely, step 508 of method 500 may include assembling a removable and re-usable filter. Step 508 is shown in greater detail in FIGS. 9A-9E. Namely, FIG. 9A shows a flowchart of a method 900 for assembling a removable and reusable filter. A filter so produced by method 900 may be specifically configured to fit into a facemask in accordance with this disclosure, and so may be optimized to allow the necessary placement location on the facemask (on a cheek, leave the mouth and lips unobstructed) while also being removable and reusable in order to minimize filter waste and turnover.

Specifically, first step 902 of method 900 may include producing an inner filter frame and an outer filter frame. Each of the inner filter frame and outer filter frame may be substantially in a shape that corresponds to a shape of a filter cavity. In the embodiments discussed above, this shape may be a parallelogram. Generally, the inner filter frame may have an inner filter frame first inner dimension and an inner filter frame second inner dimension—and the outer filter frame may have an outer filter frame first inner dimension that is larger than the inner filter frame first dimension by the thickness of the inner filter frame, and the outer filter frame may have an outer filter frame second dimension that is larger than the inner filter frame second dimension by the thickness of the inner filter frame. In this way, the outer filter frame may fit securely around the inner filter frame.

Figure 9B:
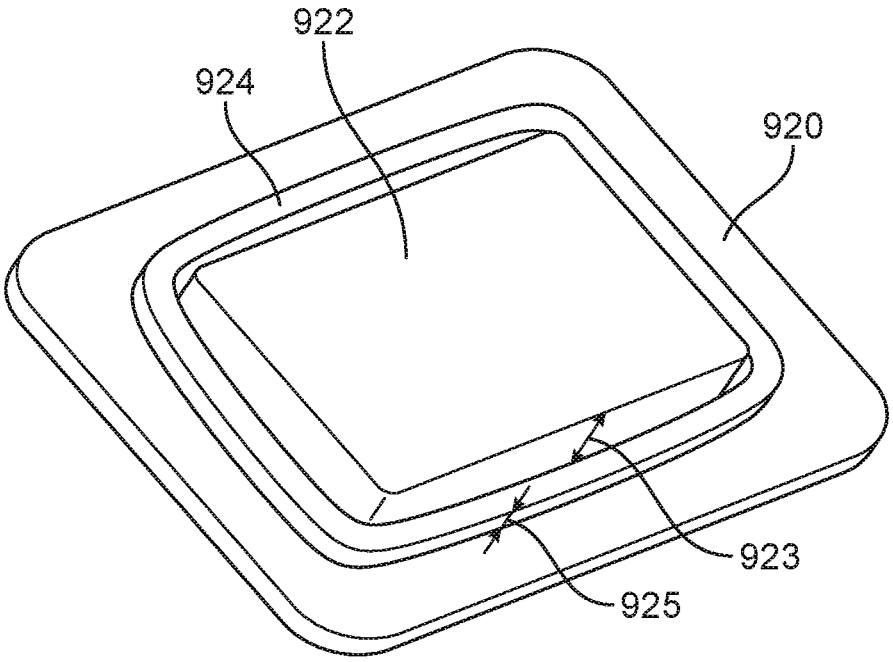
FIG. 9B is a top isometric view of a first step in manufacturing a removable and re-usable filter for a facemask.

Next, step 904 of method 900 may include placing the inner filter frame onto a filter manufacturing form. FIG. 9B shows step 904 in greater detail. Namely, inner filter frame 924 may be placed onto filter manufacturing form 920. Filter manufacturing form 920 may include raised portion 922. Raised portion 922 may have a height 923 that is greater than a height 925 of inner filter frame 924. Raised portion 922 may have a shape substantially the same as an inner shape of the inner filter frame 924.

Figure 9C:
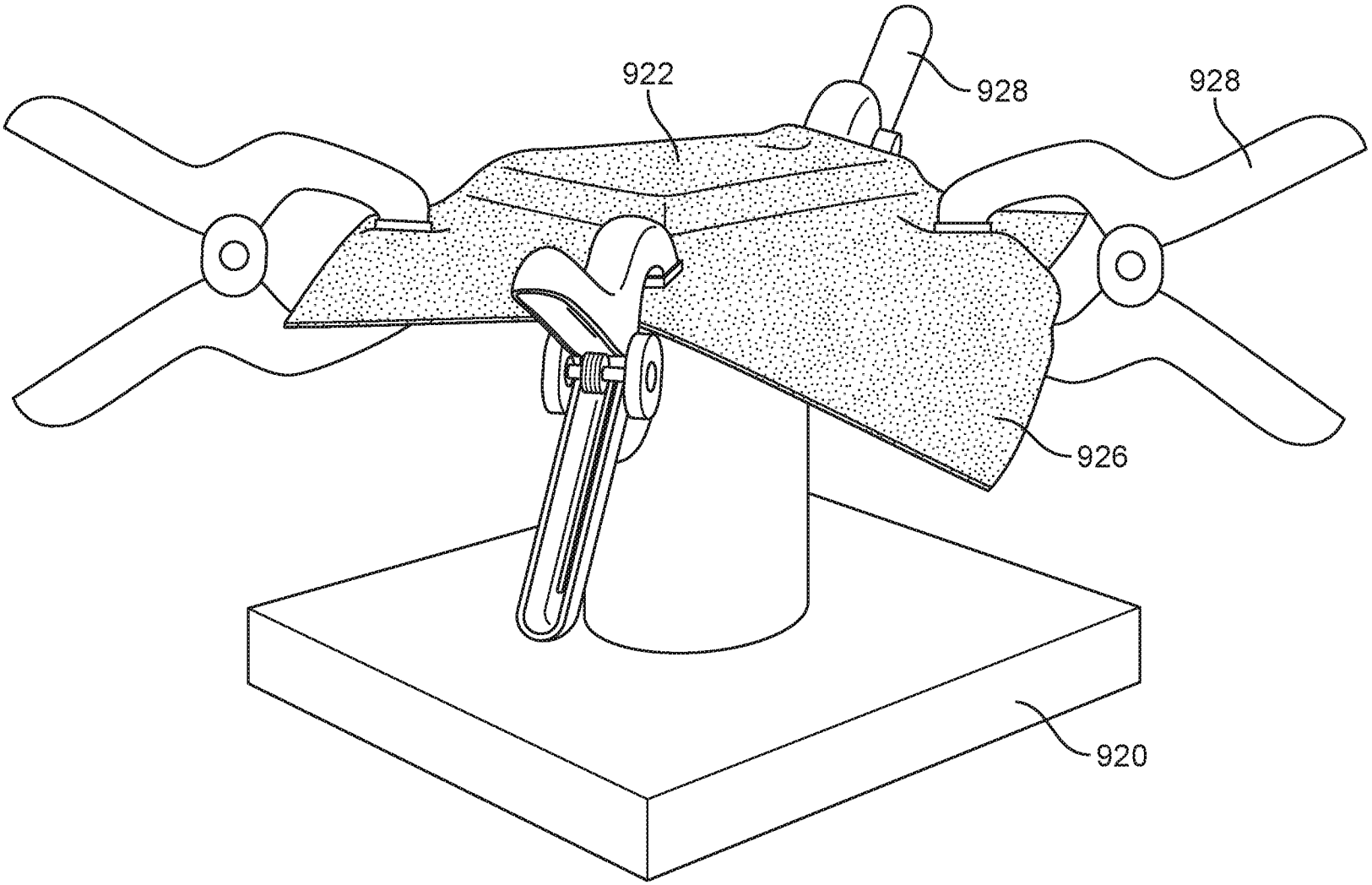
FIG. 9C is an isometric view of a second step in manufacturing a removable and re-usable filter for a facemask.

Step 906 of method 900 may next include aligning a filter fabric over the raised portion of the filter form, then folded down so as to be adjacent to the inner filter frame, and then attached to the inner filter frame. FIG. 9C shows an embodiment of this step. Namely, filter fabric 926 may be placed over raised portion 922 of filter manufacturing form 920. Filter fabric 926 may then be folded down along the edges of raised portion 922, and held in place by clamps 928.

The filter fabric may generally be a fabric having a greater than 99% Bacterial Filtration Efficiency rating according to standard ASTM F2101, the content of which is hereby incorporated by reference. For example, such a filter fabric may be commercially available from Halyard as marketed under the Halyard Powerguard technology fabric. The fabric may be attached to the inner filter frame by gluing, and then clamping to hold the filter fabric in place while the glue sets—as shown in FIG. 9C.

Figure 9D:
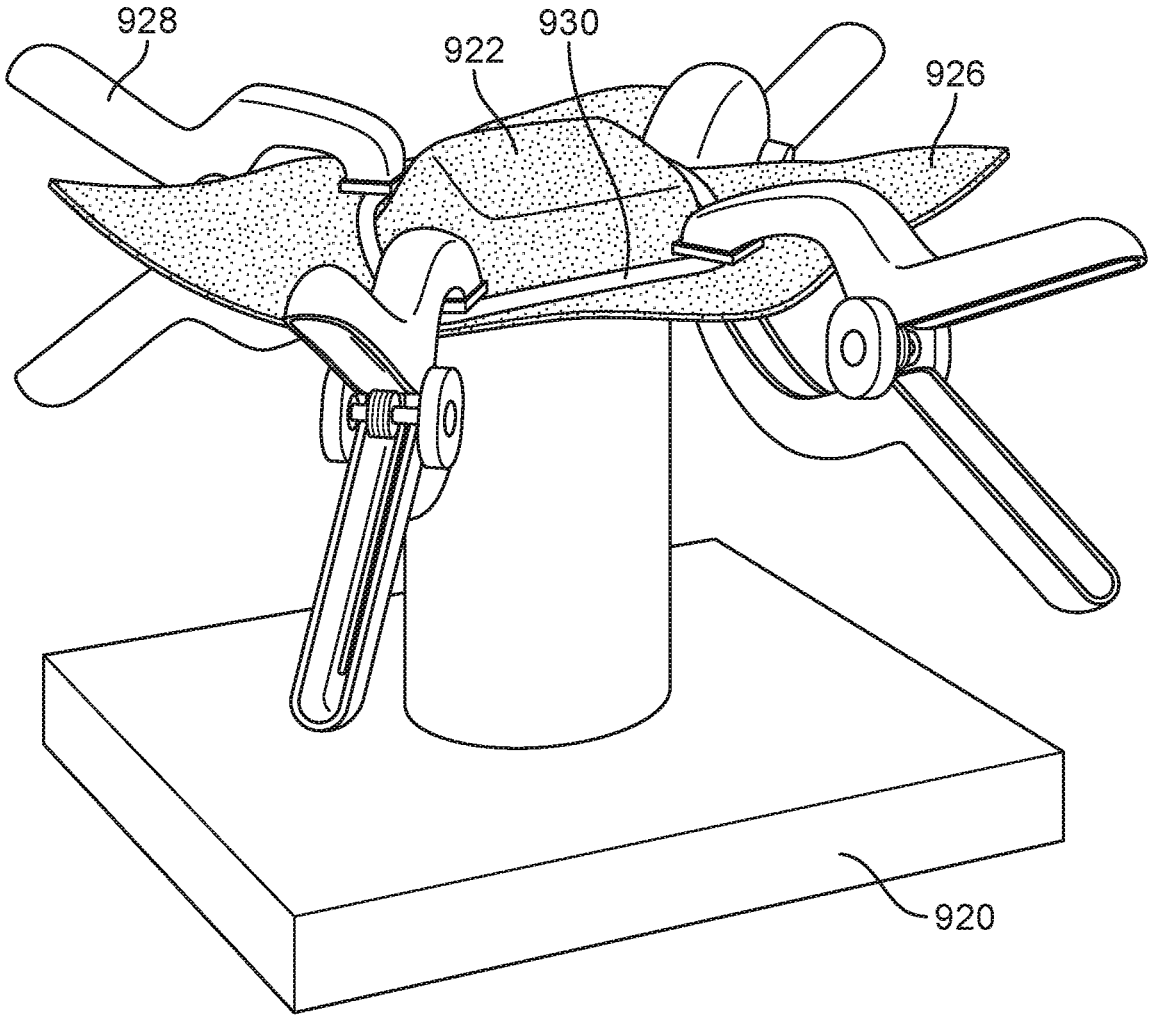
FIG. 9D is an isometric view of a third step in manufacturing a removable and re-usable filter for a facemask.

Next, as shown in FIG. 9D, the method 900 of FIG. 9A may include a step 908 of placing the outer filter frame 930 around the inner filter frame 924 on top of the filter fabric 926. Filter fabric 926 may therefore be sandwiched between inner filter frame 924 and outer filter frame 930. Step 908 may also include attaching outer filter frame 930 to filter fabric 926. Again, the attachment may be done using commercially available glue—and then using clamps 928 to hold outer filter frame 930 in place while the glue sets.

Figure 9E:
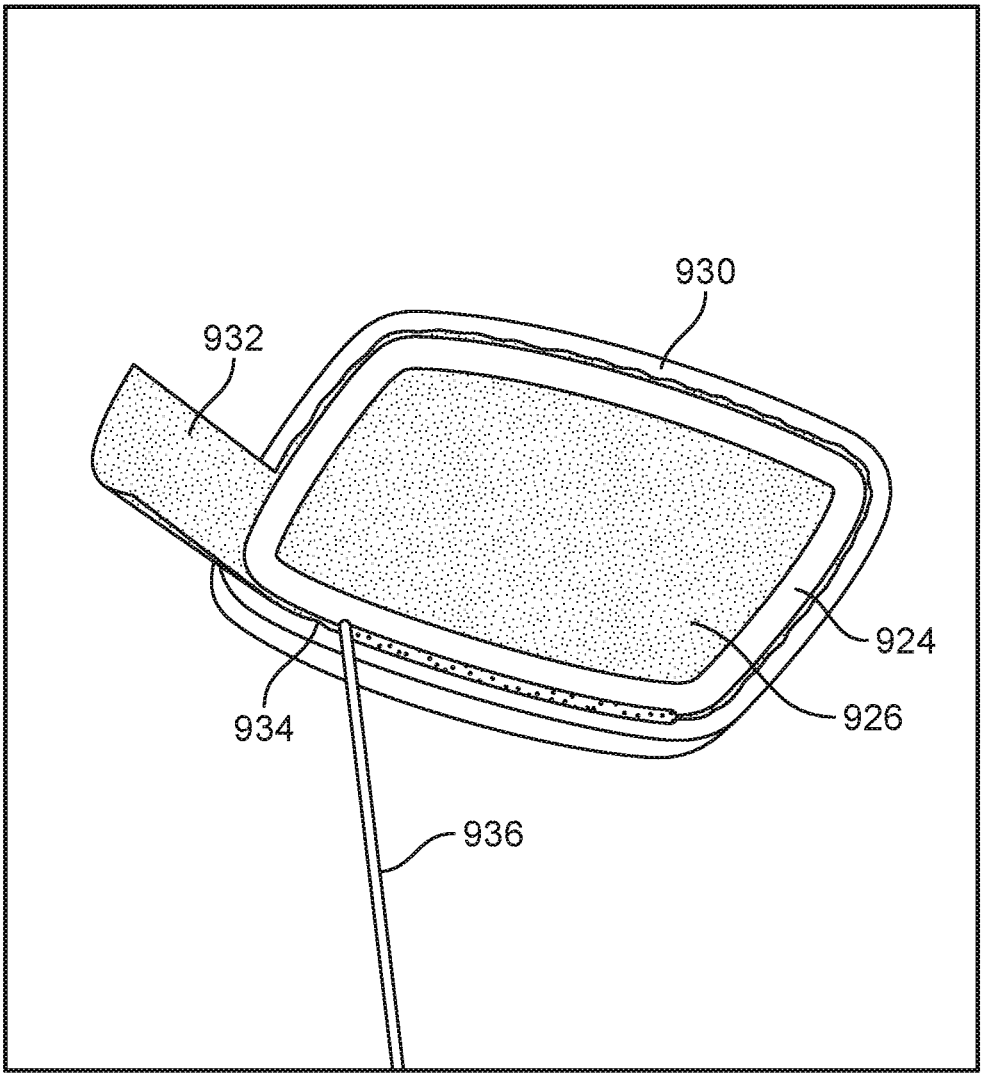
FIG. 9E is a top view of a fourth step in manufacturing a removable and re-usable filter for a facemask.

Once the outer filter frame is completely attached to the filter fabric (e.g. the glue has dried), then excess filter fabric 926 may be removed in step 910 of method 900. In some embodiments, excess filter fabric may extend beyond the perimeter of outer filter frame 930 and will therefore be trimmed off. However, a filter fabric tab 932 that is configured to allow a user to grasp the filter may remain extending beyond the perimeter of the outer filter frame 930, as shown in FIG. 9E.

Finally, step 912 of method 900 may include sealing a filter seam 934 where the filter fabric 926 is sandwiched between the inner filter frame 924 and the outer filter frame 930. This step is shown in FIG. 9E. This sealing step may use an acetone glue 936, so as to prevent any airflow through this seam.

Accordingly, steps 902-912 of method 900 shown in FIG. 9A may correspond to step 508 in method 500 shown in FIG. 5.

In this way, the final filter that is produced from this method may include an area corresponding to a cross-sectional area of the inner filter frame, and also a depth corresponding to a height of the raised portion 922 of the filter form 920. This may allow the filter to include more total filter fabric 926 so as to meet a minimum amount of filter fabric needed in the filter.

For example, in certain embodiments, each filter may include at least 10.5 square inches of filter fabric 926 in order to best filter particulates and droplets while allowing appropriate airflow for the wearer to breathe. This total area threshold may therefore be achieved within a small filter cross-sectional footprint on the facemask by adding filter depth. In this way, the height 923 of the raised portion 922 on the filter form 920 may be configured such that a total area of filter fabric included in the filter is at least 10.5 square inches. This total area of filter fabric 926 may then expand into a filter cavity depth, such as depth 216 in facemask 200 discussed above.

In facemask embodiments with two filters, each filter may include at last 10.5 square inches of filter fabric. Accordingly, the total amount of filter fabric included in the facemask may be at least 21 square inches. This value may correspond to a threshold that may be suitable for airflow conducive to human breathing, or a threshold other determined by a filter fabric manufacturer.

Next, step 510 of method 500 as shown in FIG. 5 may include inserting the filter manufactured in step 508 into the facemask unibody manufactured in steps 504 and 506. As discussed above, this many include using a snap-in ridge in the facemask unibody to retain the filter within a filter cavity.

Finally, step 512 of method 500 may include attaching one or more straps to the facemask unibody. A strap may generally be made from an elastic material, and in some embodiments may include a strap retaining mechanism thereon that allows the strap to be tightened to a preferred length once the facemask is fit onto the user's face.

Next, this disclosure also provides methods of distribution and customization of facemasks in order to provide wearers with appropriately fitting facemasks. As is generally known in the art, facemasks often must fit the wearer securely and snugly in order to a facemask to pass an industry standard (like the N95 facemask standard) or be used in certain contexts (like in the medical field).

As discussed, a facemask in accordance with this disclosure may be made from a thermoplastic polymer having a sufficiently low glass transition temperature that it may be heated by a customer using conventionally available heating equipment (such as boiling water) and then adjusted in shape to better fit the customer's face. This may further ensure that the facemask prevents exposure to particulates, without the need for uncomfortable pressure on the wearer's face from the straps.

In particular, a facemask in accordance with this disclosure may comprise a thermoplastic polymer having a glass transition temperature of less than about 100 degrees Celsius, such that the facemask is configured to be heated by a user in order to adjust the facemask from a first shape to a second shape in order to better fit the user's face.

Figure 10A:
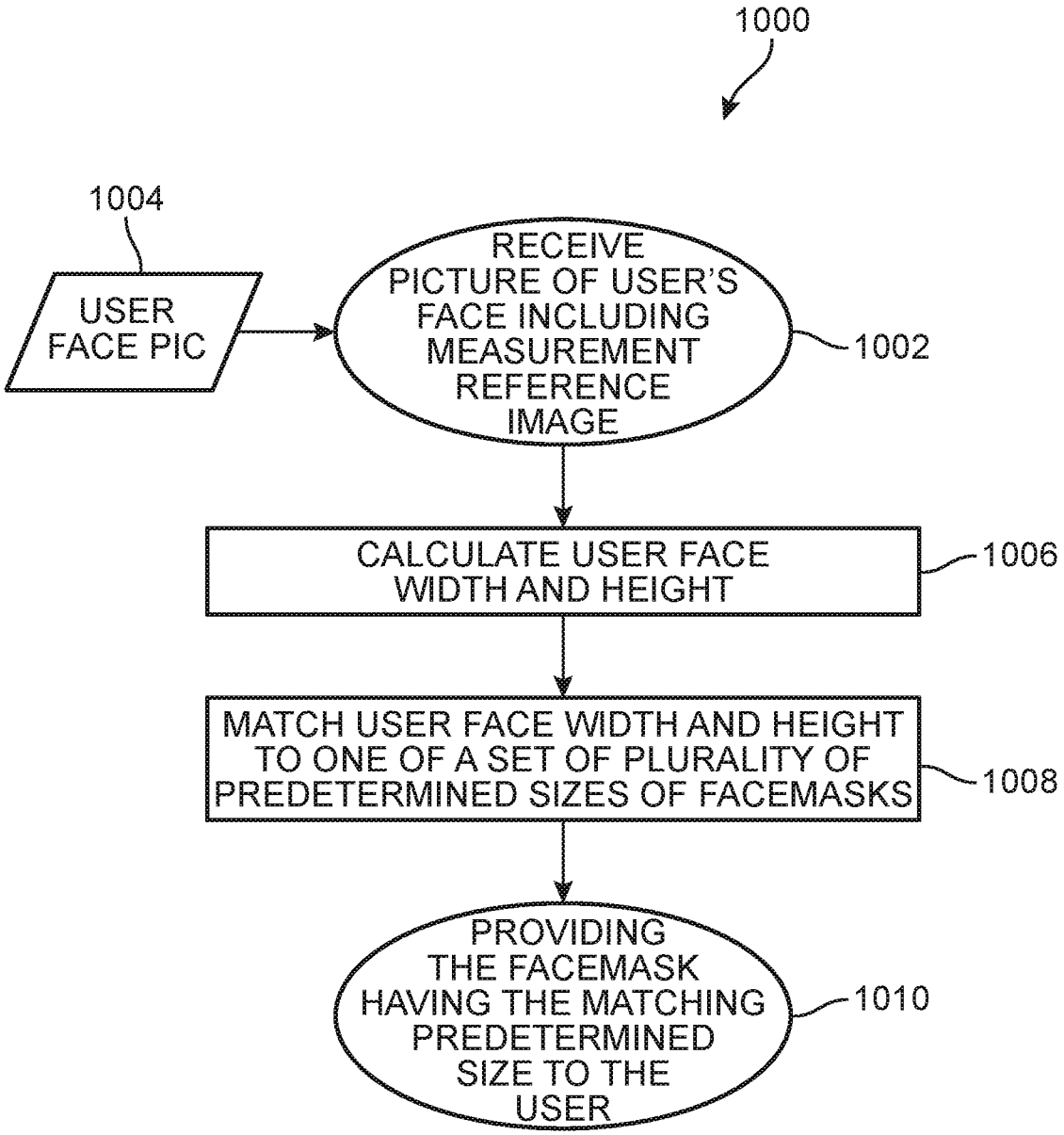
FIG. 10A is a flowchart showing a first method of customizing a facemask to a user.

In particular, FIG. 10A shows a flowchart of a first embodiment of a method of customization 1000. Method 1000 may be a method of fitting and distributing a properly sized facemask to a user. Namely, a first step 1002 of method 1000 may include receiving a picture 1004 of a user's face that includes a measurement reference image.

Figure 10B:
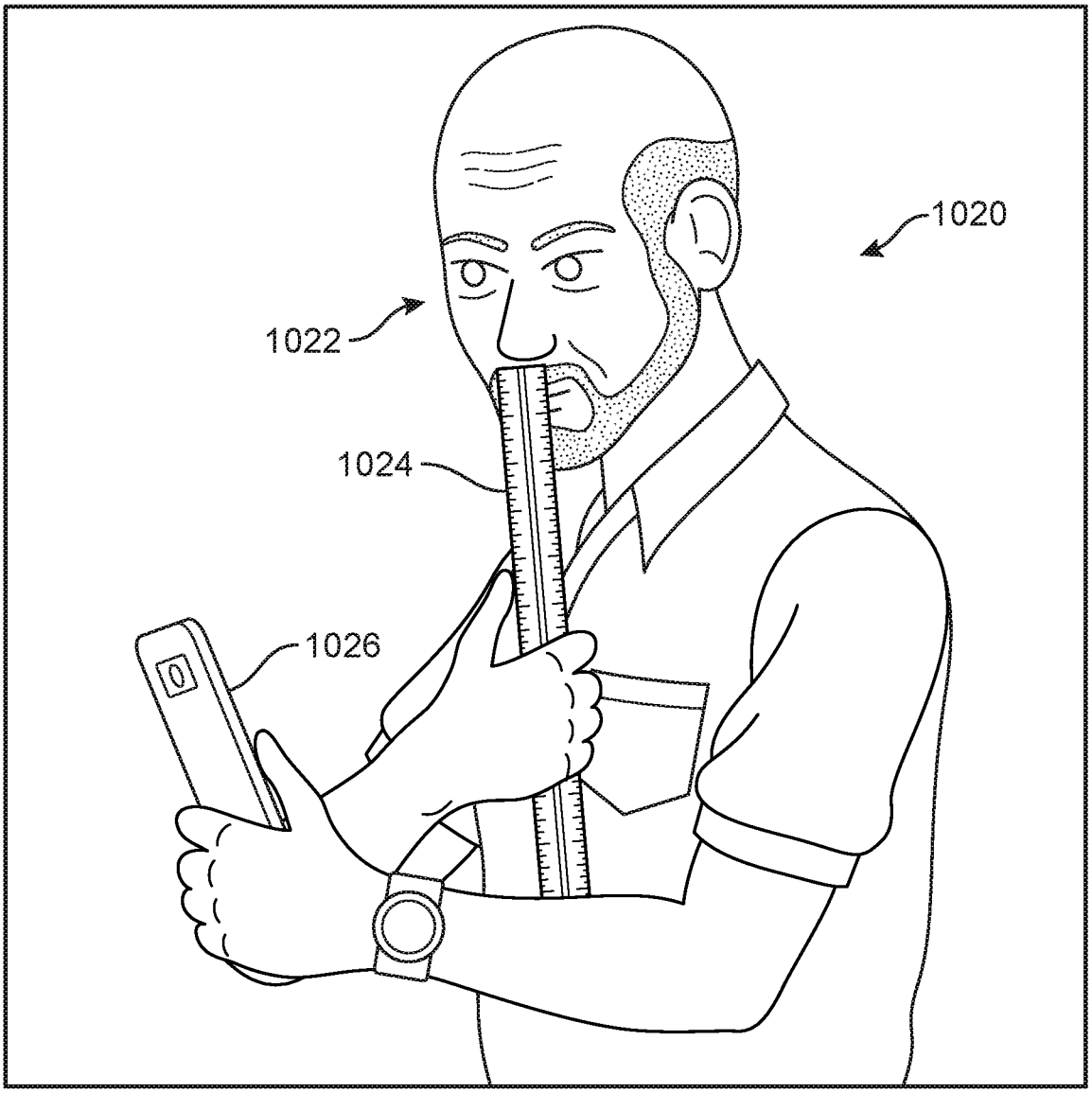
FIG. 10B is an illustration of a self-portrait picture used in the method of FIG. 10A.

A user face picture 1004 may be a "selfie" picture taken with a smartphone or other mobile computing device. FIG. 10B shows an embodiment of user face picture 1004 being taken by a user 1020 with a smartphone 1026. The picture as depicted in FIG. 10B may include the user's face 1022 and a measurement reference image 1024 therein. Namely, a user 1020 may hold a tape measure 1024 up to their face to allow the picture 1004 to have a reference by which to determine the absolute size of the user's face 1022 features.

After receiving the use face pic, step 1006 in method 1000 may include calculating a user face width and height. In some embodiments, this may be done automatically through image recognition technology. Then, at step 1008 method 1000 may include matching the calculated user face width and user face height to one of a set of a plurality of predetermined sizes of facemasks. A set of a plurality of predetermined sizes of facemasks may be as is shown in FIG. 6 and discussed above.

Namely, the plurality of predetermined sizes of facemasks may include facemasks having a first width, facemasks having a second width that is larger than the first width, and facemasks having a third width that is larger than the second width—and also facemasks having a first height, facemasks having a second height that is larger than the first height, and facemasks having a third height that is larger than the second height.

In some embodiments, the step 1008 of matching the user face dimensions to one of a set of a plurality of predetermined sizes of facemask may include matching the user face width to the closest of the first width, the second width, and the third with—and also matching the user face height to the closest of the first height, the second height, and the third height. However, more broadly the step 1008 of matching the user face dimensions to one out of a set of a plurality of predetermined sizes of facemasks may include matching any number of corresponding dimensions between the user face dimensions calculated from the user's face picture and any number of values of dimensions of the facemasks. This may include, for example, any number of corresponding widths or heights.

In some embodiments, the closest matching dimension of a facemask may be the numerically smallest value of an absolute value of the difference between the facemask dimension and the user face dimension. That is, the size of the facemask dimension that is closest to the corresponding user face dimension may be either larger or smaller than the size of the user face dimension. However, in other embodiments, the step of matching may use a threshold determination. For example, the step of matching the user face dimensions to one of a plurality of predetermined sizes of facemasks based on the facemask dimensions may involve matching to a facemask having a dimension value that is not less than the value of the user face dimension.

In the particular embodiment mentioned above with three facemask widths and three facemask heights, this may involve matching the user face width to the closest of the first width, the second width, and the third width that is not less than the user face width—and matching the user face height to the closest of the first height, the second height, and the third height that is not less than the user face height. In this way, a threshold matching algorithm may allow each user to be matched with an appropriately sized facemask that can then be customized by the user by slightly reducing the dimension at issue. In some embodiments, a post-sale customization that slightly reduces a dimension may be easier for a customer to achieve without significantly affecting the shape of the facemask than a customization that seeks to enlarge a dimension.

Finally, step 1010 of the method 1000 shown in FIG. 10A may include providing the facemask having the matching predetermine size to the user. In this way, an entity performing the method 1000 shown in FIG. 10A may match a user with an appropriate fitting facemask based on a "selfie" picture of the user's face, and then subsequently allow the user to further customize the facemask through post-sale modification of the shape of the facemask to better fit the user's face. Modification may be done as variously discussed above and below, such as by heating.

Figure 11A:
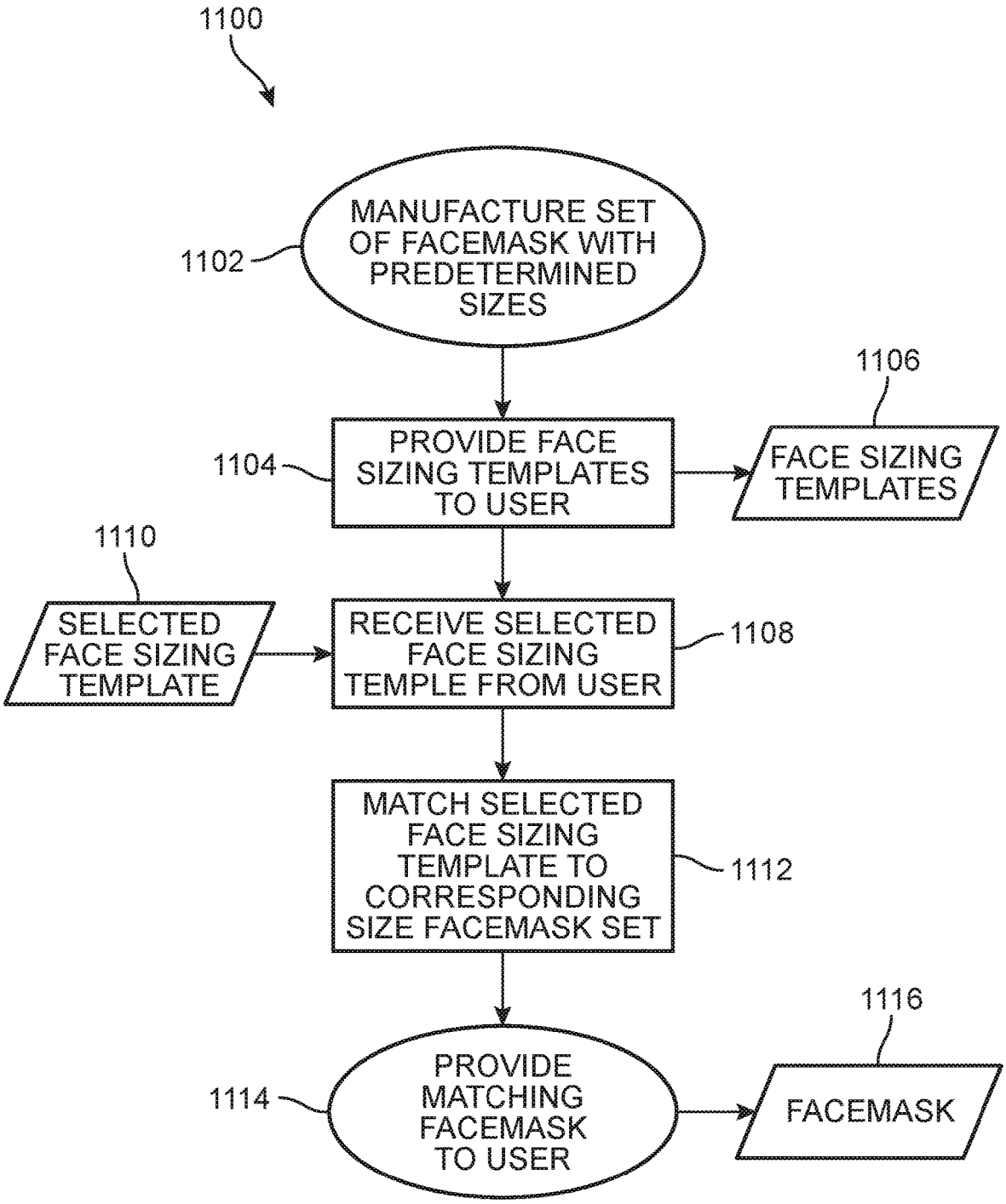
FIG. 11A is a flowchart showing a second method of customizing a facemask to a user.

FIG. 11A shows another embodiment of a method 1100 of customizing a facemask to a user. Method 1100 may begin with step 1102 of manufacturing a set of a plurality of predetermined sizes of facemasks. Step 1102 may correspond to method 500 as shown in FIG. 5, and the set of plurality of facemasks that are manufactured from set 600 shown in FIG. 6.

Figure 11B:
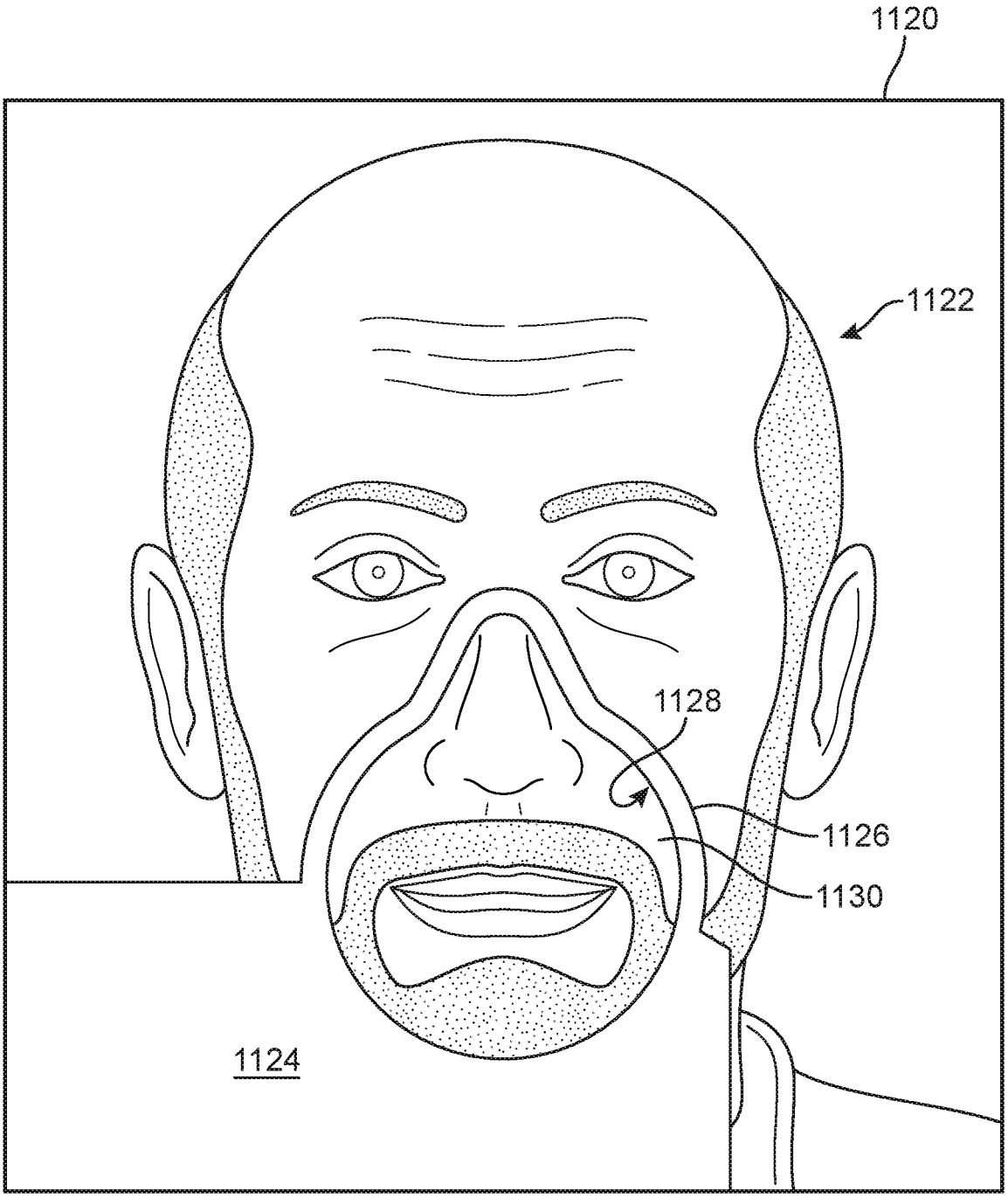
FIG. 11B shows a facemask size selection template used in the method of FIG. 11A.

Next, method 1100 may include a step 1104 of providing a plurality of face sizing templates 1106 to a user. Face sizing templates 1106 may correspond to the predetermined sizes of facemasks manufactured in step 1102. On example of a face sizing template is shown in FIG. 11B. Namely, FIG. 11B shows face sizing template 1124 that includes cutout area 1130 surrounded by sizing line 1128 being held up to the face 1126 of user 1122. Face sizing template 1124 may be a printable document that can be printed on an 8 by 11.5 sheet of copy paper using a home computer. In this way, a user may receive a set of six (for example) face sizing temples 1106, print the templates at home using a home computer, and then hold each template to their own face to select which size best fits their face.

Method 1100 may then receive the selected face sizing template 1110 from the user at step 1108. For example, a facemask manufacturer may perform method 1100—and so the manufacturer may receive the selected sizing temple 1110 from the user, such as through a website or via an email order for a facemask.

In response to receiving the selected face sizing temple 1110 at step 1108, method 1100 may then match the selected sizing template 1110 to one of the facemasks in the set of plurality of predetermined sizes of facemasks. In various embodiments, this matching may be done manually by an operator, or automatically via an algorithm.

Thus, in step 1114 a method 1100 may include providing the matching facemask 1116 to the user. That is, the manufacturer may carry out method 1100 in order to customize which facemask best fits a user, and then provide that facemask to the user.

Figure 12:
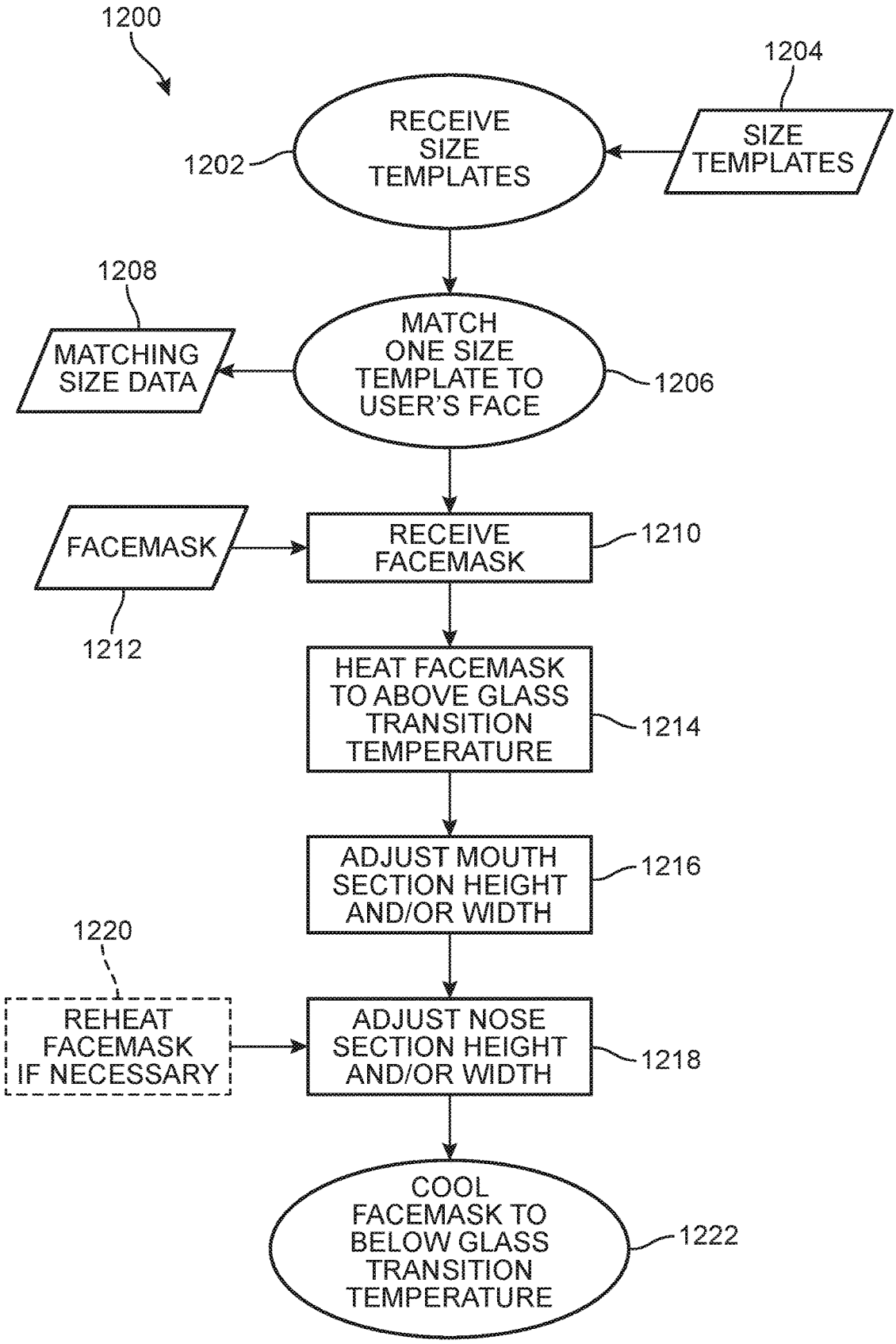
FIG. 12 is a third method of customizing a facemask to a user.

Finally, FIG. 12 shows another embodiment of a method 1200 of customizing a facemask. This embodiment may be performed from the perspective of a user/customer who is going to wear the facemask. From this perspective, in a first step 1202 the user may receive a set of size templates 1204. The user performing method 1200 may then match one of the size templates to their face at step 1206—and provide the matching size data 1208 to another party such as the facemask manufacturer or seller.

In response, at step 1210 the user may receive a facemask 1212 that corresponds to the matching size data 1208. Steps 1202, 1206, and 1210 in method 1200 may correspond to steps 1104, 1108, and 1114 in method 1100 as shown in FIG. 11A and discussed above.

However, method 1200 may include additional customization steps. Namely, in step 1214 a user may heat the facemask to above the glass transition temperature of the thermoplastic polymer making up the facemask unibody.

In this step 1214, the customer/user thus performs post-sale customization of the facemask to better fit the user's face. Namely, the facemask may have a first shape when it is received from the third party entity—and then the customer may customize at least one dimension of the facemask so that the facemask then has a second shape that better conforms to the user's face. For example the facemask may have a first height and a first width when received from the third party entity, and then may have a second height that differs from the first height and a second width that differs from the first width after customer customization.

In the particular embodiment shown in FIG. 12, the method 1200 may include two steps of post-sale customization by the user. For example, in a first post-sale customization step 1216 the user may adjust a first section of the facemask. The first section of the facemask may be a mouth section of the facemask. The mouth section may extend from the bottom of the chin area to a top of the upper lip area. In this step, the user may adjust either or both of the mouth section height and width, or any portion thereof. FIG. 2D shows these heights and widths, as discussed above.

In a next step 1218 of the method of FIG. 12, the second part of a two-part post-sale customization may be performed. In this step, the user may customize a second section of the facemask. The second section may be a nose section of the facemask, extending from the top of the above mentioned mouth section to the upper side of the facemask on a nose bridge area as shown in FIG. 2D. If necessary, the facemask may be reheated at step 1220 before performing the second customization step.

Finally, the method 1200 of FIG. 12 includes cooling the facemask back down to a temperature below the glass transition temperature of the thermoplastic polymer at step 1222. In this way, the facemask may again be substantially rigid—but now in a shape that comfortably fits the user's face without undue pressure.

As a result of all of the above, a facemask may be customized in order to fit comfortable and pass any industry standard fit tests to ensure a proper air seal between the facemask and the user's face. Notably, the air seal may be accomplished with a facemask in accordance with this disclosure that aids in interpersonal communication, is lightweight, is reusable, is washable, is waterproof, and offers the many advantages as discussed herein throughout.

Various features have been described herein with respect to several embodiments. It is intended to be within the scope of this disclosure to combine any feature from one embodiment with any other feature discussed in the context of another embodiment, or to change the order of any steps in any method described herein, unless otherwise necessarily excluded.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

The invention claimed is:

1. A facemask, comprising:

a facemask unibody comprising a clear thermoplastic polymer; the facemask unibody being a single continuous piece of PETG;

an airflow hole in the facemask unibody, configured to allow airflow from an outer side of the facemask into an inner side of the facemask;

a removable filter covering the airflow hole on an inner side of the facemask unibody;

the airflow hole and the removable filter being located on the facemask in a location that is adjacent to a user's mouth when worn; and a strap;

wherein the facemask unibody has a shape such that the facemask covers the user's mouth and nose when worn;

wherein the facemask unibody has a shape such that the facemask conforms to the user's nose bridge, upper cheeks, lower cheeks, and chin thereby creating a seal between the facemask and the user's skin when worn;

wherein the thermoplastic polymer has a glass transition temperature of less than about 100 degrees Celsius, such that the facemask is configured to be heated by a user in order to adjust the facemask from a first shape to a second shape in order to better fit the user's face;

wherein the facemask has a first total height and a first total width, and the facemask is configured to change total height from the first total height to a second total height upon heating and adjustment by the user, and change total width from the first total width to a second total width upon heating and adjustment by the user.

2. The facemask according to claim 1, wherein the facemask further comprises a filter adaptor;

wherein the removable filter is a N95 filter; and wherein the filter adaptor is configured to removably attach the N95 filter to the facemask.

3. The facemask according to claim 1, wherein the facemask includes the removable filter covering the airflow hole and a second removable filter covering a second airflow hole;

each removable filter being located on the facemask such that the filter covers a user's cheek when worn, leaving the user's mouth substantially unobstructed by the filters.

4. The facemask according to claim 1, wherein the removable filter includes at least 10.5 square inches of filter fabric, the filter fabric having a greater than 99% Bacterial Filtration Efficiency rating according to standard ASTM F2101.

5. The facemask according to claim 1, wherein the facemask unibody includes a filter cavity;

the filter cavity including a filter snap-in ridge configured to hold in place a filter frame associated with the removable filter;

the filter cavity having a depth extending laterally outward from a surrounding area of the facemask unibody, the filter cavity depth being configured to allow filter material to expand therein; and wherein the filter snap-in ridge is located laterally outward from the surrounding area of the facemask unibody.

6. A facemask, comprising:

a facemask unibody comprising a clear thermoplastic polymer;

a first filter cavity in the facemask unibody, the first filter cavity including a first airflow hole configured to allow airflow from an outer side of the facemask into an inner side of the facemask, and the first filter cavity including a first removable filter adjacent to and covering the first airflow hole on the inner side of the facemask unibody;

a second filter cavity in the facemask unibody, the second filter cavity including a second airflow hole configured to allow airflow from the outer side of the facemask into the inner side of the facemask, and the second filter cavity including a second removable filter adjacent to and covering the second airflow hole on the inner side of the facemask unibody;

the first removable filter and the second removable filter being located on the facemask in a location that is laterally adjacent to a user's mouth when worn; and a strap;

wherein the facemask unibody has a semi-ridged shape such that the facemask covers the user's mouth and nose when worn, and the semi-ridged shape is configured such that the facemask conforms to the user's nose bridge, upper cheeks, lower cheeks, and chin thereby creating a seal between the facemask and the user's skin when worn; and wherein the first filter cavity includes a first filter snap-in ridge configured to hold a first filter frame associated with the first removable filter in place in the first filter cavity on an inner side of the facemask unibody, and the second filter cavity includes a second filter snap-in ridge configured to hold a second filter frame associated with the second removable filter in place in the second filter cavity on an inner side of the facemask unibody;

wherein each of the first filter cavity and the second filter cavity are each continuous portions of the facemask unibody;

wherein each of the first filter cavity and the second filter cavity have a depth extending laterally outward from a surrounding area of the facemask unibody, the filter cavity depth being configured to allow filter material to expand therein in the inner side of the facemask unibody;

wherein each of the first removable filter and the second removable filter have a cross-sectional area that is smaller than a total area of filter fabric included in each of the first removable filter and the second removable filter; and wherein each of the first filter snap-in ridge and the second filter snap-in ridge are located laterally outward from the surrounding area of the facemask unibody.

7. The facemask of claim 6, wherein the thermoplastic polymer has a glass transition temperature of less than about 100 degrees Celsius, such that the facemask is configured to be heated by a user in order to adjust the facemask from a first shape to a second shape in order to better fit the user's face.

8. The facemask of claim 6, wherein the facemask unibody further includes an outer rim tab extending outward from the facemask unibody; and the facemask further includes a silicone reinforcement strip located on an outer surface of the outer rim tab extending along substantially an entire circumference of the facemask unibody.

9. The facemask of claim 6, wherein the facemask unibody is a single continuous piece of polymer that consists of the clear thermoplastic polymer.

10. The facemask of claim 6, wherein each of the first removable filter and the second removable filter includes at least 10.5 square inches of fabric, the fabric having a greater than 99% Bacterial Filtration Efficiency rating according to standard ASTM F2101.

11. The facemask of claim 6, wherein the facemask has a first total height;

the facemask has a first total width; and wherein the facemask is configured to change total height from the first total height to a second total height upon heating and adjustment by the user, and change width from the first total width to a second total width upon heating and adjustment by the user.

* * * * *